US006032464A

United States Patent [19]

Swift et al.

[11] Patent Number: 6,032,464

[45] Date of Patent: Mar. 7, 2000

[54] TRAVELING-WAVE DEVICE WITH MASS FLUX SUPPRESSION

[75] Inventors: Gregory W. Swift, Santa Fe; Scott N. Backhaus, Los Alamos; David L. Gardner, White Rock, all of N.Mex.

[73] Assignee: Regents of the University of California, Los Alamos, N.Mex.

[21] Appl. No.: 09/234,236

[22] Filed: Jan. 20, 1999

[51] Int. Cl.[7] ..... F01B 29/10

[52] U.S. Cl. ..... 60/520; 60/521; 60/522; 62/6

[58] Field of Search ..... 60/517, 520, 521, 60/522, 526; 62/6

[56] References Cited

U.S. PATENT DOCUMENTS

| | | | |
|---|---|---|---|
| 4,114,380 | 9/1978 | Ceperley | 60/721 |
| 4,355,517 | 10/1982 | Ceperley | 60/721 |
| 5,519,999 | 5/1996 | Harpole et al. | 60/520 X |
| 5,953,920 | 9/1999 | Swift et al. | 60/520 X |

OTHER PUBLICATIONS

Peter Hutson Ceperley, "Gain and Efficiency of a Short Traveling Wave Heat Engine," J. Acoust. Soc. Am., vol. 77, No. 3, pp. 1239–1244, Mar. 1985.

Peter Hutson Ceperley, "A Pistonless Stirling Engine—The Traveling Wave Heat Engine," J. Acoust. Soc. Am., vol. 66, No. 5, pp. 1509–1513, Nov. 1979.

Ray Radebaugh, "A Review of Pulse Tube Refrigeration," Adv. In Cryogenic Eng., vol. 35, pp. 1191–1205, New York, 1990.

David Gedeon, "DC Gas Flows in Stirling and Pulse–Tube Cryocoolers," Cryocooler Conference, pp. 1–7, Jun. 1996.

J.R. Olson, G.W. Swift, "Acoustic Streaming in Pulse Tube Refrigerators: Tapered Pulse Tubes," Cryogenics, vol. 37, No. 12, pp. 769–776, 1997.

*Primary Examiner*—Hoang Nguyen
*Attorney, Agent, or Firm*—Ray G. Wilson

[57] ABSTRACT

A traveling-wave device is provided with the conventional moving pistons eliminated. Acoustic energy circulates in a direction through a fluid within a torus. A side branch may be connected to the torus for transferring acoustic energy into or out of the torus. A regenerator is located in the torus with a first heat exchanger located on a first side of the regenerator downstream of the regenerator relative to the direction of the circulating acoustic energy; and a second heat exchanger located on an upstream side of the regenerator. The improvement is a mass flux suppressor located in the torus to minimize time-averaged mass flux of the fluid. In one embodiment, the device further includes a thermal buffer column in the torus to thermally isolate the heat exchanger that is at the operating temperature of the device.

22 Claims, 16 Drawing Sheets

(Prior Art Refrigerator)

(Prior Art Engine)

TRAVELING-WAVE DEVICE WITH MASS FLUX SUPPRESSION

STATEMENT REGARDING FEDERAL RIGHTS

This invention was made with government support under Contract No. W-7405-ENG-36 awarded by the U.S. Department of Energy. The government has certain rights in the invention.

FIELD OF THE INVENTION

The present invention relates generally to traveling-wave engines and refrigerators, and, more particularly, to traveling-wave engines and refrigerators that perform as Stirling engines and refrigerators.

BACKGROUND OF THE INVENTION

There are a number of important antecedents to this invention. The most important antecedents are Stirling engines and refrigerators, a century old. An important step in the elimination of moving parts from Stirling engines and refrigerators came in 1969, when William Beale invented the "free-piston" variety of Stirling devices, in which the crankshaft and linkages were replaced by gas springs, so that gas spring constants and piston masses could be chosen to cause resonant motion of the pistons with the desired frequency, amplitudes, and phases.

Ceperley, "Gain and efficiency of a short traveling-wave heat engine," 77 *J. Acoust Soc. Am.,* pp. 1239–1294 (1985) suggested that the essence of Stirling engines and refrigerators is a regenerator (and adjacent heat exchangers) in which the pressure and velocity oscillations are substantially in phase, reminiscent of an acoustic traveling-wave, and hence that an acoustic network with essentially toroidal topology containing the Stirling heat-exchange components can provide such phasing. Ceperley claimed that efficiencies near 80% of the Carnot efficiency are in principle possible with such configurations. Ceperley's contribution could be seen as an extension of Beale's, in that Ceperley uses gas inertia effects in addition to Beale's gas spring effects, thereby eliminating the massive pistons of Beale's invention. Other related teachings by Ceperley are set out in U.S. Pat. No. 4,113,380, issued Sep. 19, 1978, and U.S. Pat. No. 4,355,517, issued Oct. 26, 1982. However, Ceperley presented no teachings on how to realize a practical device.

The conventional orifice pulse tube refrigerator (OPTR) (Radebaugh, "A review of pulse tube refrigeration," 35 Adv. *Cryogenic Eng.,* pp. 843–844 (1992)) operates thermodynamically like a Stirling refrigerator, but with the cold moving parts replaced by passive components: a thermal buffer column known as the pulse tube, and a dissipative acoustic impedance network. The efficiency $\dot{Q}_C|\dot{W}$ of an OPTR is fundamentally limited by the temperature ratio $T_C/T_0$, which is lower than the Carnot value $\dot{T}_C/(T_0-T_C)$ because of the inherent irreversibility in the dissipative acoustic impedance network. T is temperature, $\dot{Q}_C$ is heat, $\dot{W}$ is work, and the subscripts 0, and C refer to ambient and cold, respectively. The OPTR can be regarded as another means to eliminate moving parts from Stirling devices. However, the efficiency of an OPTR is fundamentally less than that of a Stirling device, and the OPTR is only applicable to refrigerators.

Conventional OPTRs have long used the thermal buffer column known as a pulse tube, but until recently this component carried substantial heat leak. However, using a tapered tube, as described in U.S. patent application Ser. No. 08/975,766, filed Nov. 21, 1997, can reduce the heat leak along such a thermal buffer column to as little as 5% of the cooling power of a OPTR. Thermal buffer columns have been used in two-piston Stirling refrigerators as well as in OPTRs, but not in Stirling engines.

In the context of double-inlet OPTRs, Gedeon, "DC gas flows in Stirling and pulse-tube cryocoolers," in Ross ed., *Cryocoolers* 9, pp. 385–392 (Plenum, N.Y. 1997) discusses how nonzero time-averaged mass flux $\dot{M}$ can arise in Stirling and pulse-tube cryocoolers whenever a closed-loop path exists for steady mass flux. It is essential that $\dot{M}$ through a Stirling engine or refrigerator be near zero, to prevent a large steady energy flux $\dot{M}c_p(T_0-T_C)$ from adding an unwanted thermal load to the cold heat exchanger of a refrigerator, or to prevent a large steady energy flux $\dot{M}c_p(T_H-T_0)$ from removing a large amount of heat from the hot heat exchanger of an engine—in either case, reducing the efficiency. Here $c_p$ is the gas isobaric specific heat per unit mass.

Another, less directly related antecedent to this invention is the set of prior thermoacoustic engines and refrigerators developed in the past 20 years at Los Alamos National Laboratory and elsewhere. These operate on an intrinsically irreversible cycle, using nearly standing-wave phasing between gas pressure oscillations and velocity oscillations and using deliberately imperfect thermal contact in the stack (which might otherwise be mistaken for a regenerator). The intrinsic irreversibility and other practical issues have thus far limited the best standing-wave thermoacoustic engines and refrigerators to below 25% of the Carnot efficiency.

Various objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the present invention includes a pistonless Stirling device. Acoustic energy circulates in a direction through a fluid within a torus. In one embodiment, a side branch is connected to the torus for transferring acoustic energy into or out of the torus. A regenerator is located in the torus with a first heat exchanger located on a first side of the regenerator downstream of the regenerator relative to the direction of the circulating acoustic energy; and a second heat exchanger located on a second side of the regenerator, where one of the heat exchangers is at an operating temperature and the other one of the heat exchangers is at ambient temperature. The improvement herein comprises a mass flux suppressor located in the torus to minimize time averaged mass flux of the fluid. In one embodiment, the device further includes a thermal buffer column adjacent to the heat exchanger at the operating temperature to thermally isolate the heat exchanger at the operating temperature.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings:

FIGS. 12A and 12B are a cross-sectional side view and a top view, respectively, of a variable slit mass flux suppressor for use in the present invention.

DETAILED DESCRIPTION

In accordance with the present invention, a new class of engines and refrigerators operate thermodynamically like Stirling engines and refrigerators, but all moving parts are eliminated by using acoustic phenomena in place of the pistons that have previously been used in Stirling devices. Thus, both the efficiency advantage of the Stirling cycle (whose inherent limit is the Carnot efficiency) and the no-moving-parts simplicity/reliability advantage of intrinsically irreversible thermoacoustics are obtained in these devices.

Figure 1A:
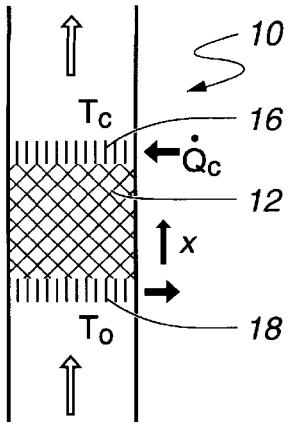
FIGS. 1A and 1B schematically depict the heat-exchange components of a prior art Stirling-cycle refrigerator and accompanying phasor diagram, respectively.
Figure 2A:
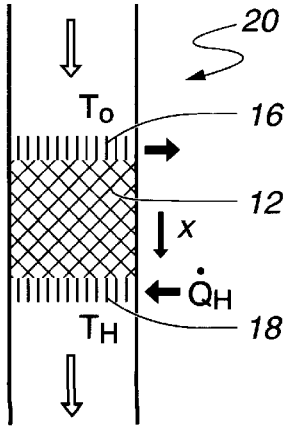
FIGS. 2A and 2B schematically depict the heat-exchange components of a prior art Stirling-cycle engine and accompanying phasor diagram.

The essential components of a Stirling refrigerator 10 and a Stirling engine 20, shown in FIGS. 1A and 2A, are regenerators 12, each with two adjacent heat exchangers 16, 18. A gas (or other thermodynamically active fluid) is made to experience pressure oscillations and displacement oscillations throughout these components, with phasing such that acoustic power enters the components at the ambient-temperature end $T_0$ and leaves at the other end at cold temperature $T_C$, or hot temperature $T_H$, as shown by the long broad arrows in FIGS. 1A and 2A. Regenerators 12 have heat capacity, and the gas passages within regenerators 12 have hydraulic radii smaller than the thermal penetration depth in the gas.

To consider the thermodynamic cycle quantitatively, assume the essential physics to be spatially one dimensional, with x specifying the coordinate along the direction of oscillatory gas motion. Conventional counterclockwise phasor notation is used, so that time-dependent variables are expressed as $$\xi(x,t)=\xi_m(x)+Re[\xi_1(x)e^{i\omega t}] \tag{1}$$

with the mean value $\xi_m$ real and independent of time t, and with $\xi_1(x)$ complex to account for both the magnitude and phase of the oscillation, which occurs at angular frequency $\omega=2\pi f$, where f is the ordinary frequency. An acoustical point of view is presented, using the vocabulary of acoustic resistance, inertance, compliance, and transmission line to discuss the lumped and distributed impedances associated with the components of the engine or refrigerator. This approach has been successful previously, even within regenerators (see, e.g., Swift et al., "Simple harmonic analysis of regenerators," 10 *Journal of Thermophysics and Heat Transfer,* pp. 652–662 (1996)). The present approach focuses primarily on conventional acoustic variables: pressure amplitude $p_1$ and volumetric velocity $U_1$. The positive direction for x and $U_1$ is taken as the direction of positive acoustic power flow.

Figure 1B:
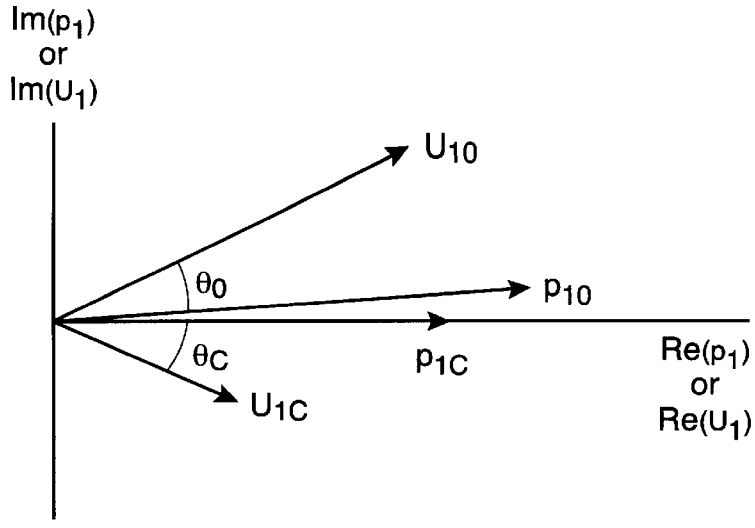
Figure 2B:
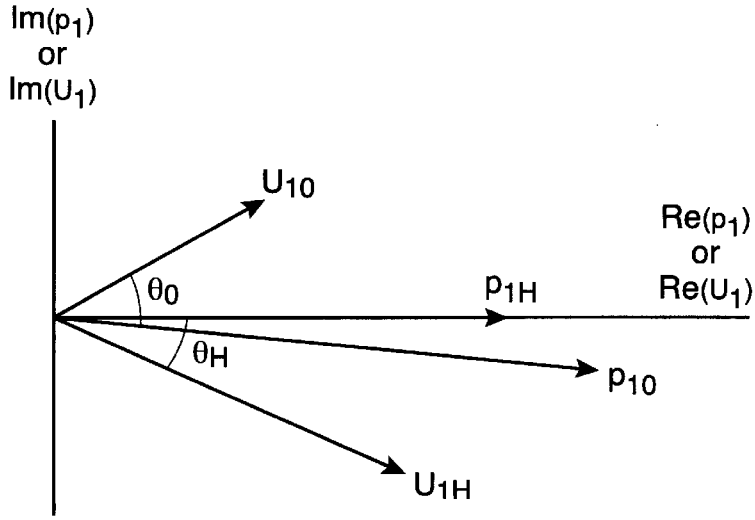

Features of phasor diagrams for efficient Stirling engines and refrigerators are shown in FIGS. 1B and 2B. The capitalized subscripts on variable such as $p_1$ and $U_1$ correspond to the locations labeled with T having the same subscripts in FIGS. 1A and 2A and subsequent Figures. The arbitrary convention is adopted that the phases of the pressure at the refrigerator's cold heat exchanger (e.g., heat exchanger 16, FIG. 1A) and the engine's hot heat exchanger (e.g., heat exchanger 18, FIG. 1A) are zero, so $p_{1C}$ in FIG. 1B and $p_{1H}$ in FIG. 2B fall on the real axis. Typically the pressure drop across the heat exchangers is negligible compared to that across the regenerator, which is in turn small compared to $|p_1|$, so $p_{10}$ must lie close to $p_{1C}$ or $p_{1H}$, as shown in FIGS. 1B and 2B.

Typically the time-averaged energy flux through the regenerator is small. Applying energy conservation to cold heat exchanger 16 in FIG. 1A then shows that the cooling power $\dot{Q}_C$, shown by the short heavy arrow, is about equal to the total acoustic power flowing out of the cold heat exchanger in the positive x direction, $\dot{W}_C=\frac{1}{2}\mathrm{Re}[p_{1C}\tilde{U}_{1C}]=\frac{1}{2}|p_{1C}||U_{1C}|\cos\theta_C$, shown by the long arrow in FIG. 1A, where $\theta_C$ is the phase angle between $p_{1C}$ and $U_{1C}$. In fact, heat leaks can flow to the cold heat exchanger, so the acoustic power is an upper bound on the actual cooling power:

$$\dot{Q}_C\leq\tfrac{1}{2}Re[p_{1C}\tilde{U}_{1C}] \tag{2}$$

In FIG. 1A, in order to achieve positive cooling power, acoustic power must flow in the direction shown with the long arrows, in the positive x direction, so $U_{10}$ and $U_{1C}$ must lie in the right half plane in FIG. 1B. An idealized regenerator might be imagined with negligible entrained gas volume, so that $\rho_m U_1$ U would be independent of x in the regenerator (where $\rho_m$ is the gas mean density), and in particular the phase of $U_1$ would be constant throughout the regenerator. However, it is well known that nonzero gas volume in the regenerator causes x dependence in $U_1$ proportional to the local gas volume and to $i\omega p_1$. This leads to a spread in phase of $U_1$ through the system, with $U_1$ at small x (i.e. toward ambient heat exchanger 18) leading. The most efficient regenerator operation occurs when $|U_1|$ is as small as possible for a given cooling power, because this leads to minimal viscous pressure drop across the regenerator and minimal energy flux through the regenerator due to imperfect thermal contact in the regenerator. To achieve small $|U_1|$ for a given $\dot{W}_C$, $U_1$ should be nearly in phase with $p_1$, so the phase of $p_1$ should fall somewhere between the phases of $U_{1C}$ and $U_{10}$. Viscous pressure drop occurs throughout the regenerator, so $p_{10}-p_{1C}$ must be in phase with (parallel to) some weighted average of $U_1$ in the regenerator. Both $|U_1|$ and viscosity are highest at the regenerator's ambient end $T_0$, so the weighted average is typically dominated by $U_{10}$, usually ensuring that $p_{10}$ leads $p_{1C}$. All these features are illustrated in FIG. 1B.

Much of the above discussion also applies directly to an engine. As noted above, the components of a Stirling engine, shown in FIG. 2A, are nearly identical to those of a Stirling refrigerator. The main difference is that regenerator 12 in the engine produces work while the refrigerator's regenerator 12 absorbs work. This difference can be seen in the phasor diagram of FIG. 2B. With $\theta_0<90°$, acoustic power flows into the ambient side of regenerator 12. The mean temperature $T_m(x)$ rises from $T_O$ to $T_H$ through regenerator 12. This increase in $T_m$ causes $\rho_m$ to fall. Since the first-order mass flux $\rho_m U_1$ is nearly independent of x, the volume velocity increases, so $|U_{1H}|>|U_{10}|$. In addition, the volume of gas entrained in the regenerator causes the phase of $U_1$ to rotate in a similar fashion as in the refrigerator. These two effects locate $U_{1H}$ relative to $U_{10}$ in FIG. 2B. The amplification of the acoustic power is indicated by $$\tfrac{1}{2}|p_{1H}||U_{1H}|\cos\theta_H>\tfrac{1}{2}|p_{10}||U_{10}\cos\theta_0.$$

Since the time-averaged energy flux through regenerator 12 is small, the acoustic power flowing out of hot heat exchanger 18 is nearly equal to the heat flowing into hot heat exchanger 18. Again, heat leaks and other losses reduce this power making $Q_H$ an upper bound on the acoustic power, i.e., $\tfrac{1}{2}\mathrm{Re}(p_{1H}\tilde{U}_{1H})\leqq\dot{Q}_H$. The location of $p_{10}$ relative to $p_{1H}$ is due to viscous pressure drop within regenerator 12, with the difference $p_{10}-p_{1H}$ proportional to a weighted average of $U_1$ through regenerator 12. Similar to the refrigerator, the viscous effects are largest at the hot end of regenerator 12, where $|U_1|$ is largest and viscosity is largest. Hence, with $U_{1H}$ dominating, $p_{10}$ lags $p_{1H}$ slightly.

Returning now to the refrigerator, as discussed above, the acoustic power $$\dot{W}_C=\frac{\omega}{2\pi}\int_0^{2\pi/\omega}p(t)U(t)dt=\frac{1}{2}Re\left[p_{1C}\tilde{U}_{1C}\right] \tag{3}$$

flows out of the refrigerator's 10 cold heat exchanger 16. As taught by Ceperley, ideally this acoustic power should be transmitted without loss to the ambient heat exchanger. To accomplish this, Ceperley prescribed a full-wavelength torus transmitting the acoustic wave. But, in accordance with one aspect of the present invention, it is advantageous to use a much shorter sub-wavelength torus 30, shown schematically in FIG. 3, because it is more compact.

Figure 3:
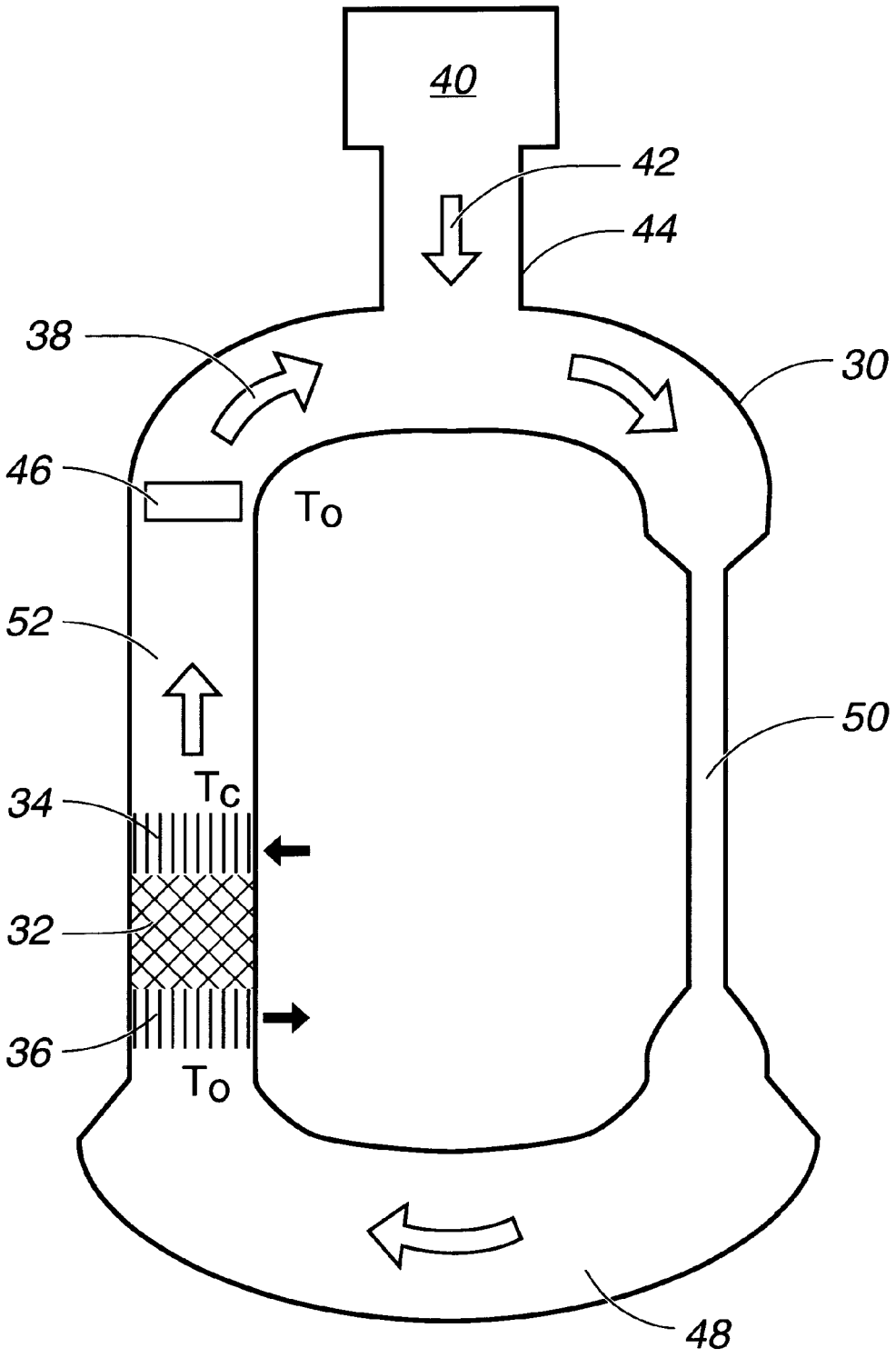
FIG. 3 schematically depicts one embodiment of a Stirling-cycle refrigerator according to the present invention.

FIG. 3 shows an embodiment of a refrigerator version of the present invention. A torus 30 with total length less than a quarter of the acoustic wavelength contains the Stirling refrigerator regenerator 32 and two heat exchangers 34, 36. As used herein, the term "torus" means a pipe, tube, or the like that defines a circulation path that is a loop that is circular or elongated, having a cross-section for supporting an acoustic wave, preferably circular. Acoustic power 38 circulates clockwise around torus 30, as shown by the long arrows. Additional acoustic power 42 generated by acoustic device 40 (such as an intrinsically irreversible thermoacoustic engine, a loudspeaker, a motor-driven piston, or a traveling-wave engine) enters torus 30 from side branch 44, to make up for acoustic power lost in regenerator 32 and elsewhere in the torus. As more fully explained below, a mass flux suppressor 46 is located within torus 30 to reduce the time-averaged mass flux $\dot{M}$ substantially to zero.

In one embodiment, the flow resistance of mass flux suppressor 46, shown in FIG. 3, has a resistance $R_M$ such that $$p_{1C}-p_{1J}=R_M U_{1M}, \tag{4}$$

where subscript J signifies the location of the junction between torus 30 and side branch 44. A compliance portion 48 of torus 30 ensures that the volumetric velocity $U_{1L}$ through an inertance portion 50 of torus 30 differs from that through ambient heat exchanger 36:

$$U_{1L}=U_{10}+j\frac{\omega V_0}{\gamma p_m}p_{10} \tag{5}$$

where $V_0$ is the volume of the compliance portion 48 of torus 30, so that the pressure difference across inertance 50 is $$p_{1J}-p_{10}=j\omega\frac{\rho_m l}{S}\left(U_{10}+j\frac{\omega V_0}{\gamma p_m}p_{10}\right) \tag{6}$$

where l and S are the length and area, respectively, of inertance 50. Taking the phasors at C, M, and 0 to be given and combining Equations (4) and (6) to eliminate $p_{1J}$, a single complex equation is obtained in the unknowns $R_M$, $V_0$, l, and S, generally with many possible solutions that enable a refrigerator to be built according to the present invention.

Figure 4:
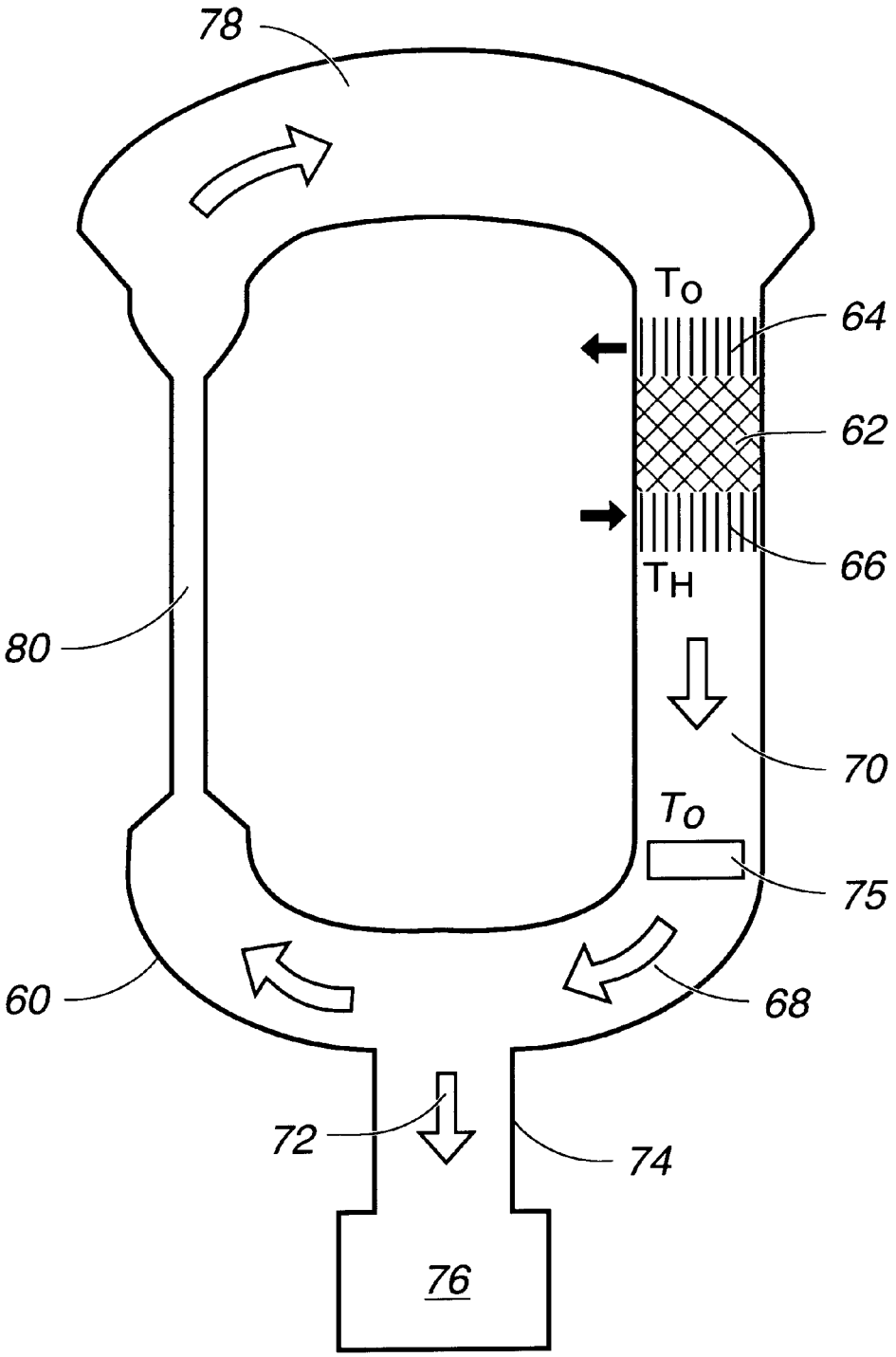
FIG. 4 schematically depicts one embodiment of a Stirling-cycle engine according to the present invention.

An embodiment of the engine version of the invention is shown schematically in FIG. 4. Torus 60, whose total length is less than a quarter wavelength, contains the Stirling engine's regenerator 62 and heat exchangers 64, 66. As shown by the long arrows 68, acoustic power circulates clockwise around torus 60. Surplus acoustic power 72 generated by the engine may be tapped off by side branch 74, and is available to perform useful work through acoustic device 76 (which could be a piezoelectric or electrodynamic transducer, an orifice pulse tube refrigerator, or a refrigerator according to the present invention). Acoustic power 68 circulates around the torus and provides the input work to the ambient end $T_0$ of the Stirling engine. Therefore, this circulating work 68 replaces the ambient piston in a conventional Stirling engine. Mass-flux suppressor 75 again acts to reduce the time-averaged mass flux $\dot{M}$ toward zero. The analysis of short torus 60 is entirely parallel to Equations (4)–(6), and follows by merely replacing the subscript C with H.

The choice of an operating frequency for the devices shown in FIGS. 3 and 4 involves a compromise among many issues. High frequency leads to high power per unit volume of the device, because many thermodynamic cycles are performed per unit time and because lengths of the device along propagation direction x scale approximately with wavelength, which is inversely proportional to frequency. On the other hand, low frequency eases the design and construction of heat exchangers and regenerators, whose pore sizes scale approximately with thermal penetration depth, which is inversely proportional to the square root of the frequency.

The fact that acoustic power will naturally circulate clockwise around the tori of FIGS. 3 and 4, even though the tori are shorter than a quarter of an acoustic wavelength in exemplary embodiments, seems surprising. But consider the electrical circuits of FIGS. 5A and 5B, containing a resistance R, an inductance L, and a capacitance C, crudely analogous to the acoustic circuits of FIGS. 3 and 4, respectively. Resistance R is crudely analogous to the regenerator and heat exchangers, inductance L is analogous to the acoustic inertance, and capacitance C is analogous to the acoustic compliance.

Figure 5A:
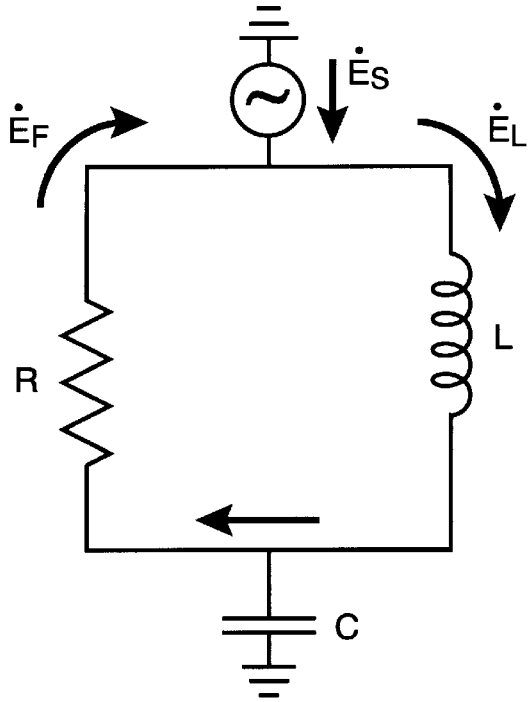
FIGS. 5A and 5B depict electrical circuit analogues for basic aspects of the present invention.
Figure 5B:
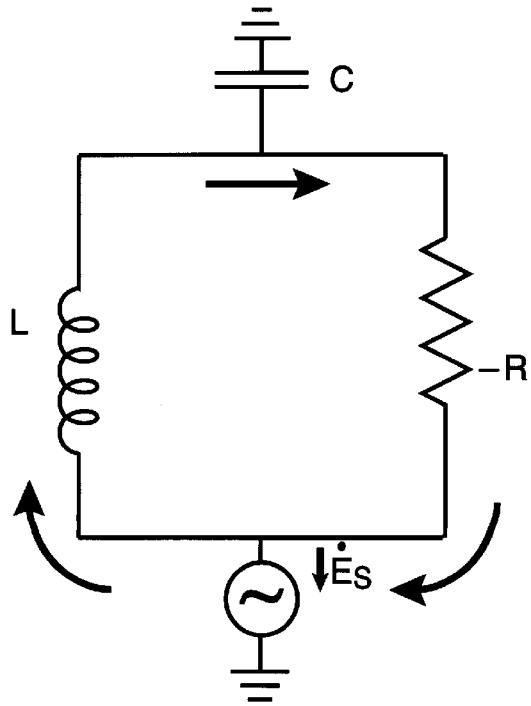

Derivation of expressions for the ac currents in each component of the electrical circuits is straightforward, and allows further derivation of expressions for the electric power $\dot{E}$ flowing at each location in the circuit. In these idealized circuits, no time-averaged power can be absorbed in the dissipationless inductor L nor flow into the dissipationless capacitor C. Ordinary ac circuit analysis easily yields the fed-back power $$\dot{E}_F = \frac{1}{2}Re\left[V_{1S}\tilde{I}_{1R}\right] = \frac{|V_{1S}|^2}{2R}\omega^2 L\frac{C(1-\omega^2 LC)}{(1-\omega^2 LC)+(\omega L/R)^2} \tag{7}$$

in FIG. 5A, with the sign convention as shown in the figure. Hence, whenever $\omega^2 LC<1$ the directions of time-averaged power flow are as shown by the arrows in FIG. 5A; with positive electric power flowing clockwise around the circuit, analogous to the clockwise circulation of acoustic power in FIG. 3. By energy conservation, the time-averaged power $\dot{E}_L-\dot{E}_F$ dissipated in the resistor must equal the time-averaged power $\dot{E}_S=\frac{1}{2}\mathrm{Re}|V_{1S}\tilde{I}_{1S}|$ flowing from the voltage source into the circuit. If the resistance R is negative, as shown in FIG. 5B, power also circulates in the clockwise direction and the time-averaged power created in the negative resistance flows out of the circuit and into the voltage source.

It will be apparent to those skilled in the art of acoustics that inertances 50, 80 in FIGS. 3 and 4 may include significant compliance, and that compliances 48, 78 in FIGS. 3 and 4 may include significant inertance. In fact, the function of these components may be served equally well by a short acoustic transmission line having distributed inertances and compliances throughout. For ease of discussion herein, the inertance and compliance are considered as lumped components.

In the refrigerator of FIG. 3, it is desirable to eliminate heat leaks from ambient to cold heat exchanger 34 in order to have the greatest possible cooling power. Similarly, in the engine of FIG. 4 it is desirable to eliminate heat leaks from hot heat exchanger 66 to ambient in order to minimize the heater power required to run the engine. Regenerators 32, 62 provide this thermal isolation on one side of cold heat exchanger 34 (in a refrigerator) or hot heat exchanger 66 (in an engine) in the present invention, as in all prior Stirling devices. On the other side of heat exchangers 34, 66, in accordance with one aspect of the present invention, thermal buffer columns 52, 70, as shown in FIGS. 3 and 4, eliminate heat leaks. The gas in the thermal buffer columns 52, 70 can be thought of as an insulating piston, transmitting pressure and velocity from the cold 34 or hot 66 heat exchangers to ambient temperatures. The thermal buffer columns 52, 70 are exactly analogous to the pulse tube of an orifice pulse tube refrigerator. Convective heat transfer of various forms could carry heat through thermal buffer columns 52, 70 between the cold 34 or hot 66 heat exchanges and ambient temperature. To eliminate gravitational convective heat transfer, thermal buffer columns 52, 70 should usually be oriented vertically with the cold end down, as shown in FIGS. 3 and 4. To eliminate gross shuttle convective heat transfer, the thermal buffer columns 52, 70 should be longer than the peak-to-peak displacement amplitude of the gas within them. To maintain stratified oscillating plug flow in the thermal buffer column, its ends should be provided with flow straighteners (not shown). To eliminate streaming-driven convective heat transfer, thermal buffer columns 52, 70 should be tapered according to U.S. patent application Ser. No. 08/975,766, filed Nov. 21, 1997, incorporated herein by reference.

In another aspect of the present invention, the time-averaged mass flux $\dot{M}$ around the torus (torus 30, FIG. 3; torus 60, FIG. 4) is controlled to be near zero, to prevent a large steady energy flux $\dot{M}c_p(T_0-T_C)$ from flowing to cold heat exchanger 34 in the refrigerator of FIG. 3 or $\dot{M}c_p(T_H-T_0)$ flowing from hot heat exchanger 66 in the engine of FIG. 4. In traditional Stirling engines and refrigerators, $\dot{M}$ is exactly zero; otherwise, mass would accumulate steadily on one or the other end of the system. Gedeon, supra, discusses how nonzero $\dot{M}$ can arise in Stirling and pulse-tube cryocoolers whenever a closed-loop path exists for steady flow. Tori 30 (FIG. 3) and 60 (FIG. 4) clearly provide such a path; hence, the present invention minimizes $\dot{M}$.

To understand $\dot{M}$, extend the complex notation introduced in Equation (1) to second order, by writing time-dependent variables as $$\xi(x,t)=\xi_m(x)+Re[\tilde{\xi}_1(x)e^{i\omega t}]+\xi_2(x) \tag{8}$$

The new time-independent term, with subscript "2", is of great interest here.

Gedeon, supra, shows that the second-order time-average mass flux $$\dot{M}_2=\tfrac{1}{2}Re[\rho_1\tilde{U}_1]+\rho_m U_2 \tag{9}$$

is of primary concern. In acoustics, such second-order mass flux is known as streaming. Gedeon, supra, further shows that $\frac{1}{2}\mathrm{Re}[\rho_1\tilde{U}_1]=\rho_m\dot{W}_2|p_m$ in a regenerator, where $\dot{W}_2=\frac{1}{2}\mathrm{Re}[p_1\tilde{U}_1]$ is the acoustic power passing through the regenerator. Hence, $\frac{1}{2}\mathrm{Re}[\rho_1\tilde{U}_1]$ must be nonzero, and efficient regenerator operation requires that $U_2=-\frac{1}{2}\mathrm{Re}[\rho_1\tilde{U}_1]/\rho_m=-\dot{W}_2/p_m$. The consequences of ignoring this requirement can be severe. If $\dot{M}_2\neq 0$, an undesired, streaming-induced heat current $$\dot{Q}_{loss}\sim\dot{M}_2c_p(T_0-T_C),\ \text{refrigerator} \tag{11}$$

$$\sim\dot{M}_2c_p(T_H-T_0),\ \text{engine} \tag{12}$$

flows through the system. (This heat can flow through either regenerators 32, 62 or thermal buffer columns 52, 70 in FIGS. 3 and 4, depending on the sign of $\dot{M}_2$, with equally harmful effect.) For $U_2=0$, the ratio of $\dot{Q}_{loss}$ to the ordinary regenerator loss $\dot{H}_{reg}$ in the refrigerator is of the order of $$\frac{\dot{Q}_{loss}}{\dot{H}_{reg}} \sim \frac{\gamma}{\gamma-1}\frac{(T_0-T_C)}{T_0}\frac{\dot{W}_C}{\dot{H}_{reg}} \sim \frac{\gamma}{\gamma-1}\frac{(T_0-T_C)}{T_C}\frac{\dot{Q}_C}{\dot{H}_{reg}}. \quad (13)$$

In the third expression, each of the three fractions is >1 for cryocoolers; hence their product is >>1 and the unmitigated streaming-induced heat load would be much greater than the ordinary regenerator loss in a cryocooler.

Figure 6:
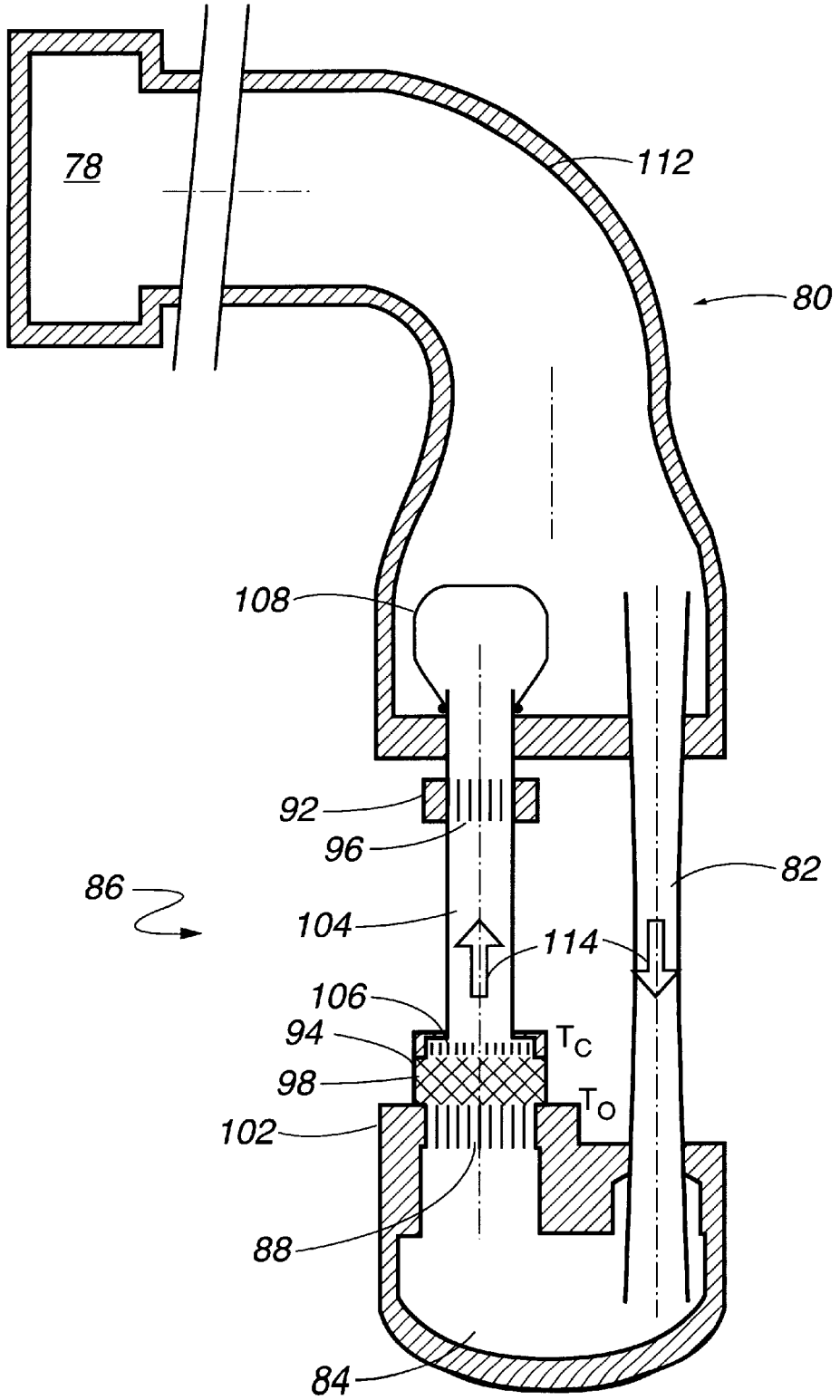
FIG. 6 is a cross-sectional view of a refrigerator version of the present invention with a diaphragm mass flux suppressor.

A laboratory version that embodies the present invention in a refrigerator is shown in FIG. 6, which is topologically identical to that of FIG. 3. Refrigerator 80 was filled with 2.4 MPa argon and operated at 23 Hz, so that the acoustic wavelength was 14 m. Refrigerator 80 was driven by an intrinsically irreversible thermoacoustic engine 78. The dash-dot lines show local axes of cylindrical symmetry. Acoustic power 114 circulates clockwise through inertance 82, compliance 84, and refrigerator parts 86 of the apparatus. Heavy flanges 102, 92 around first ambient heat exchanger 88 and second ambient heat exchanger 96 contain water jackets. O-rings, most flanges, and bolts are omitted for clarity.

Note that second ambient heat exchanger 96 is not necessary for the operation of the invention. It does provide some flow straightening for the ambient end of thermal buffer column 104. Water passages were included in second ambient exchanger 96 because the parts were being reused from unrelated tests involving a traditional OPTR configuration.

The heart of refrigerator 86, regenerator 98, was made of a 2.1 cm thick stack of 400-mesh (i.e., 400 wires per inch) twilled-weave stainless-steel screens punched at 6.1 cm diameter. The total weight of the screens in the regenerator was 170 gm. The calculated value of the hydraulic radius of this regenerator was approximately 12 $\mu$m, based on its geometry and weight. The hydraulic radius is much smaller than the thermal penetration depth of the argon (100 ρm at 300 K), as required of a good regenerator. The stainless-steel pressure vessel 94 around regenerator 98 had a wall thickness of 1.4 mm. Thermal buffer column 104 was a simple open cylinder, 3.0 cm id and 10.3 cm long, with 0.8 mm wall thickness. The diameter of buffer column 104 is much greater than the viscous penetration depth of the argon (90 $\mu$m at 300 K), and its length is greater than the 1-cm gas displacement amplitude in it at a typical operating point near $|p_1|/p_m \neq 0.1$. At each end, a few 35-mesh copper screens (not shown) served as simple flow straighteners to help maintain oscillatory plug flow in thermal buffer column 104. The high density of argon enhances the gravitational stability of this plug flow, so that careful flow straightening and tapering were not embodied in this initial laboratory refrigerator. However, a gas providing more power density, such as helium, may be used instead of argon, and the apparatus would be likely to need careful flow straightening and tapering for maximum performance. To obtain gravitational stability, the orientation of the refrigerator assembly was vertical, as shown in FIG. 6.

For test purposes, cold heat exchanger 106 between regenerator 98 and thermal buffer column 104 was a 1.8Ω length of NiCr ribbon wound zigzag on a fiberglass frame. Wires from the heater and a thermometer passed axially along the thermal buffer column to leak-tight electrical feedthroughs at room temperature. The two water-cooled heat exchangers (first ambient heat exchanger 88 and second ambient heat exchanger 96) were of shell-and-tube construction, with the Reynolds number of order $10^4$ at $|p_1|/p_m \neq 0.1$ in the argon inside the 1.7-mm-diameter, 18-mm long tubes. First ambient heat exchanger 88 had 365 such tubes, and second ambient heat exchanger 96 had 91.

Inertance 82 was a simple metal tube with 2.2 cm id and 21 cm length, with 7° cones, as shown in FIG. 6, at both ends to reduce turbulent end effects. Inertance 82 and refrigerator 86 components were sealed into flat plates above and below by rubber O-rings to enable easy modifications. The flat plates were held at a fixed separation by flange extensions and a cage of stout tubes (not shown) through which long bolts passed. Compliance 84 was half an ellipsoid with 2:2:1 aspect ratio, with a volume of 950 $cm^3$.

Refrigerator 86 was configured first as shown in FIG. 6, but without flexible diaphragm 108 (which may be a balloon-type diaphragm, or the like) installed. At $|p_{1C}|/p_m = 0.068$ the refrigerator did not cool below 19° C., essentially the temperature of the cooling water supplied to the water-cooled heat exchangers that day. However, the pressure phasors were close to predictions and the refrigerator's cold temperature was very strongly independent of heat load applied to the cold heat exchanger, e.g., at $|p_{1C}|/p_m = 0.07$, an applied load of 70 W raised $T_C$ to only 35° C., as shown by the half-filled circles in FIG. 7. Hence, the acoustic phenomena and gross cooling power were substantially as expected, and an extremely large nonzero $\dot{M}$ was effectively keeping cold heat exchanger 106 thermally anchored to ambient heat exchanger 88, overwhelming the otherwise satisfactory cooling power.

Figure 7:
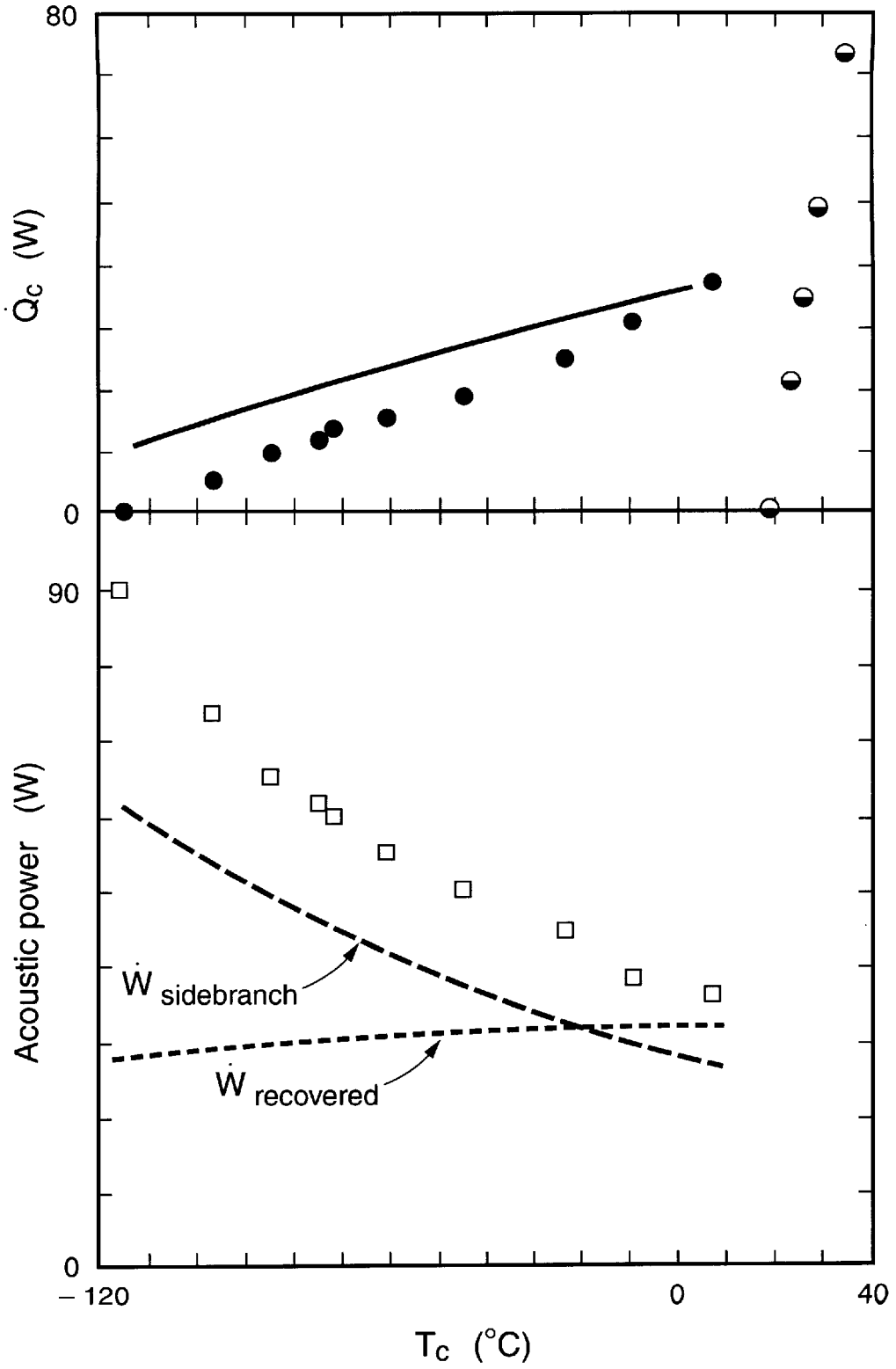
FIG. 7 graphically depicts the power flows as a function of the cold heat exchanger temperature $T_C$ for the refrigerator shown in FIG. 6.

To show that the initial refrigerator performance shown as half-filled circles in FIG. 7 was due to nonzero mass flux, flexible diaphragm 108 was installed above second ambient heat exchanger 96, as shown in FIG. 6. Flexible diaphragm 108 was selected to be acoustically transparent while blocking $\dot{M}$ completely. With flexible diaphragm 108 in place, refrigerator 86 performed well, confirming that maintaining $\dot{M} \equiv 0$ results in successful operation of this type of Stirling refrigerator. Flexible diaphragm 108 was operated at $|p_{10}|/p_m$ ranging from 0.04 to 0.10. In one set of measurements, $|p_{1C}|/p_m = 0.054$ was maintained, while varying $T_C$ from −115° C. to 7° C. by adjusting an electric heater power $\dot{Q}$Cat cold heat exchanger 106. ($T_0$=13° C. throughout.) The filled symbols and lines in FIG. 7 are the resulting measurements and calculations, respectively. The experimental points show the electric heater power $\dot{Q}_C$ applied to cold heat exchanger 106 to maintain a given $T_C$ and the line is the corresponding calculation. Experimental points also show measured acoustic power $\dot{W}_{sidebranch}$ delivered from the side branch, and the long-dash line is the corresponding calculation. The short-dash line shows calculated values of recovered power (i.e., the acoustic power passing through flexible diaphragm 108).

The data depicted in FIG. 7 show that the cooling power drops and the acoustic power supplied from the side branch rises as $T_C$ decreases. The calculations, which are in reasonable agreement with the experiments, provide insight to the main causes of these trends. First, the calculated gross cooling power $\dot{W}_C = \frac{1}{2}\mathrm{Re}[p_{1C}\tilde{U}_{1C}]$ is nearly constant at 40 W, independent of $T_C$ for these measurements. As discussed near Equation (2), under the most ideal circumstances this would be the cooling power. The decrease in calculated $\dot{Q}_C$ below 40 W as $T_C$ decreases is nearly proportional to $T_0 - T_C$ and is almost entirely due to heat flux through regenerator 98. The difference between measured and calculated $\dot{Q}_C$ is also proportional to $T_0 - T_C$, rising to 10 W at $T_C$=−120° C. This could easily be due to a combination of ordinary heat leak through the insulation and streaming- or jet-driven convection in thermal buffer column 104. Second, under the most ideal circumstances—with 40 W of cooling power and with Carnot efficiency $\dot{Q}_C|\dot{W}=T_C|(T_0-T_C)$—the required net acoustic power would be $\dot{W}=(40\text{ watts})(T_0-T_C)/T_C$ which rises from zero at $T_C=T_0$ to 35 W at $T_C=-120°$ C. This accounts for most of the 40 W rise in calculated $\dot{W}_{sidebranch}$ with falling $T_C$ in FIG. 7. The measurements of $\dot{W}_{sidebranch}$ exceed calculations by roughly 30%, for unknown reasons. Calculations show that approximately 5 W of acoustic power is dissipated in second ambient heat exchanger 96 under flexible barrier 108, 15 W is lost due to viscosity in regenerator 98 and adjacent heat exchangers 88, 106, and 10 W is dissipated in inertance 82.

If this were a traditional orifice pulse tube refrigerator, $\dot{W}_C$=40 W would be dissipated in an orifice. In FIG. 7, the calculated fedback acoustic power $\dot{W}_{recovered}$, which is one aspect of this invention, is near 30 W; hence, approximately 75% of $\dot{W}_C$ is recovered and fed back into the resonator through side branch 112. Note that at the highest temperatures $\dot{W}_{recovered}$ is comparable to $\dot{W}_{sidebranch}$. In other words, at these temperatures the toroidal configuration reduces the acoustic power delivered from intrinsically irreversible thermoacoustic engine 78 to refrigerator 80 to roughly half of what it would be in a traditional orifice pulse tube refrigerator.

Figure 8:
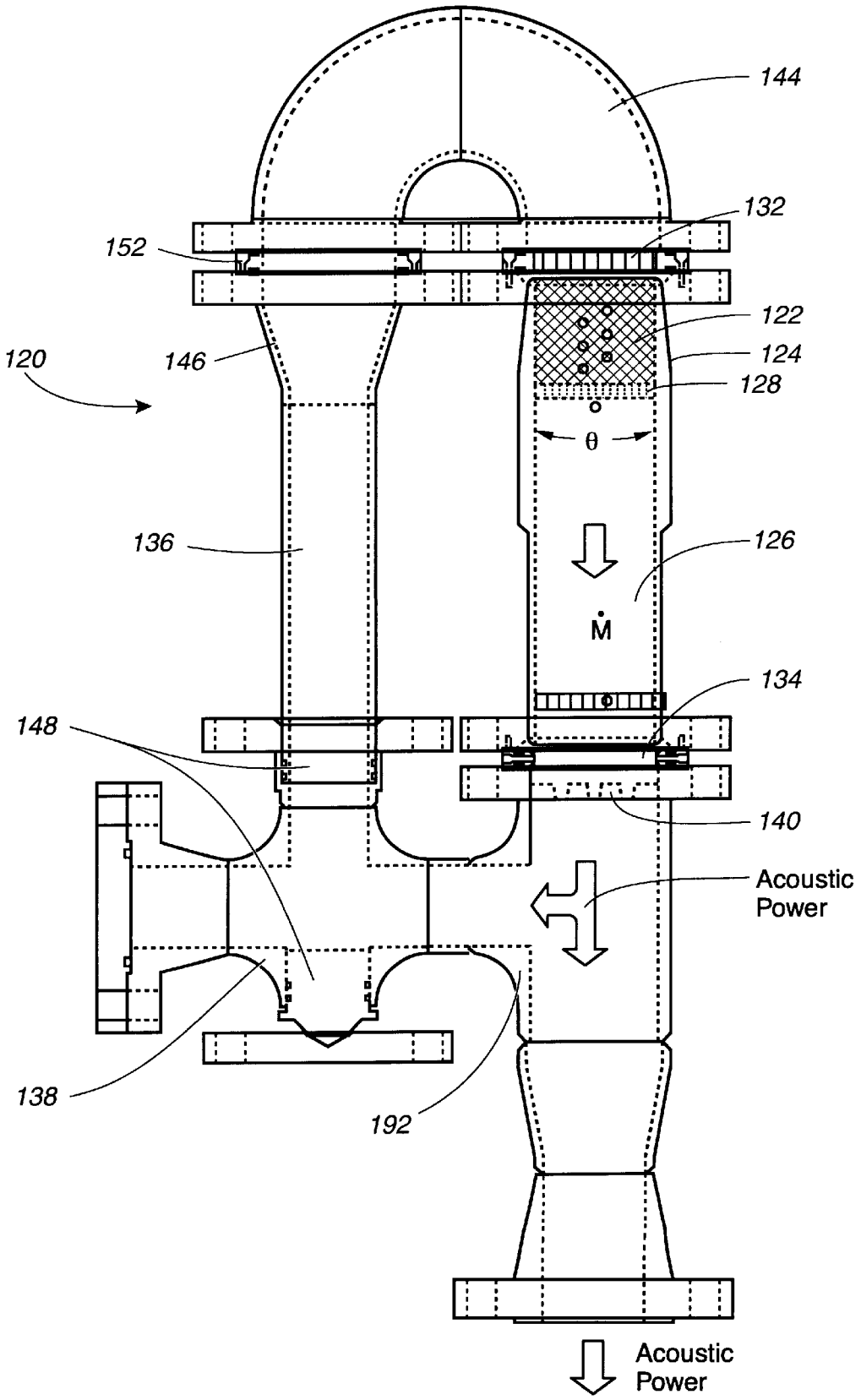
FIG. 8 is a cross-sectional view of an engine version of the present invention with a hydrodynamic mass flux suppressor.

To demonstrate an engine embodiment of this invention, engine 120 shown in FIG. 8 was constructed. It was filled with 3.1 MPa helium and operated at 70 Hz, with a corresponding acoustic wavelength of 14 m. The small circles in and below regenerator 122 indicate the location of some temperature sensors. Pressure sensors were also provided to measure $P_{10}$ and $P_{1H}$. Most external hardware is shown in the figure, except for a cage of heavy bolts surrounding the sliding joints 148, the acoustic resonator, and a variable acoustic load.

Regenerator 122 was made from a 7.3 cm stack of 120 mesh stainless steel screen machined to a diameter of 8.89 cm. The stack of screens was contained within a thin wall stainless steel can for ease of installation and removal. Based on the total weight of screen in the regenerator, the volume porosity was 0.72 and the hydraulic radius was about 42 $\mu$m. This is smaller than the thermal penetration depth of helium, which varies from 140 $\mu$m to 460 $\mu$m through regenerator 122. The stainless steel pressure vessel 124 around regenerator 122 had a wall thickness of 12.7 mm at the hot end and was tapered to a thickness of 6.0 mm at the cold end.

Thermal buffer column 126 was an open cylinder having the same inner diameter as regenerator 122 and was 26.4 cm long. Its inner diameter was much larger than the viscous and thermal penetration depths of the helium, and its length was much greater than the gas displacement (2.5 cm) at a typical operating point of $|p_1|/p_m\approx0.05$. The wall thickness was initially 12.7 mm at the hot end and was stepped down to 6.0 mm at a distance of 9.6 cm from the hot end. No effort was made to taper the thermal buffer column to suppress boundary-layer driven streaming within the column (see U.S. patent application Ser. No. 08/975,766). Operating data indicated that this form of streaming was present and was carrying several 100 Watts of heat. These measurements show the need for tapering the thermal buffer column in this type of engine. The small taper angle θ (a few degrees) shown to reduce streaming in the '766 application would not be readily apparent from FIG. 8. Thus, FIG. 8 should also be considered to include a tapered embodiment of thermal buffer column 126. It will be appreciated from the '766 application that the amount and direction of the taper that suppresses streaming is not intuitively apparent and must be determined from the particular embodiment and operating conditions of thermal buffer column 126.

For test purposes, hot heat exchanger 128 consisted of an electrically heated Ni—Cr ribbon wound zigzag on an alumina frame. Electrical leads for hot heat exchanger 128 entered thermal buffer column 126 at its ambient temperature end and passed axially up the column to the ribbon. Power flowing into hot heat exchanger 128 was measured using a commercial wattmeter.

First ambient heat exchanger 132 and second ambient heat exchanger 134 were water cooled heat exchangers of shell-and-tube construction. First ambient heat exchanger 132 contained 299 2.5 mm id, 20 mm long tubes. A typical Reynolds number in the tubes was 3,000 at $|p_1|/p_m\approx0.05$. Second ambient heat exchanger 134 contained 109 4.6 mm id, 10 mm long tubes. A typical Reynolds number in the tubes was 16,000 at $|p_1|/p_m\approx0.05$. Second ambient heat exchanger 134 was included for test purposes and would not be needed for actual use of the engine.

The main part of inertance 136 was made from commercial, schedule 40, 2.5" nominal, carbon steel pipe. Light machining was performed on the inside surface to improve the finish. To reconnect inertance 136 to the main section of the engine, a standard 2.5" pipe cross 138 and a standard 4" to 2.5" reducing tee 192 were used. The total length of inertance 136 was 59 cm, and the inside diameter was approximately 6.3 cm. Compliance 144 consisted of two commercial, 4" nominal, 90°, short radius elbows. The total volume of compliance 144 was 0.0028 $m^3$. A commercial 4" to 2.5" reducer 146 was used to smoothly adapt inertance 136 to compliance 144. Inertance 136 included sliding joints 148 to allow inertance 136 to lengthen as thermal buffer column 126 and pressure vessel 124 thermally expanded.

In the engine embodiment shown in FIG. 8, $\dot{M}_2$ was suppressed using a hydrodynamic approach, e.g., jet pump 140, discussed below. First, baselines were established for comparison. Engine 120 was run with no attempt made to block $\dot{M}_2$. Engine 120 was then operated with rubber diaphragm 152 installed at the junction between reducer 146 and compliance 144. In both of the runs, the pressure phasors $p_{10}$ and $p_{1H}$ were close to the estimates based on prior calculations. The majority of the difference between these two runs is the presence of $\dot{M}_2$.

Figure 9:
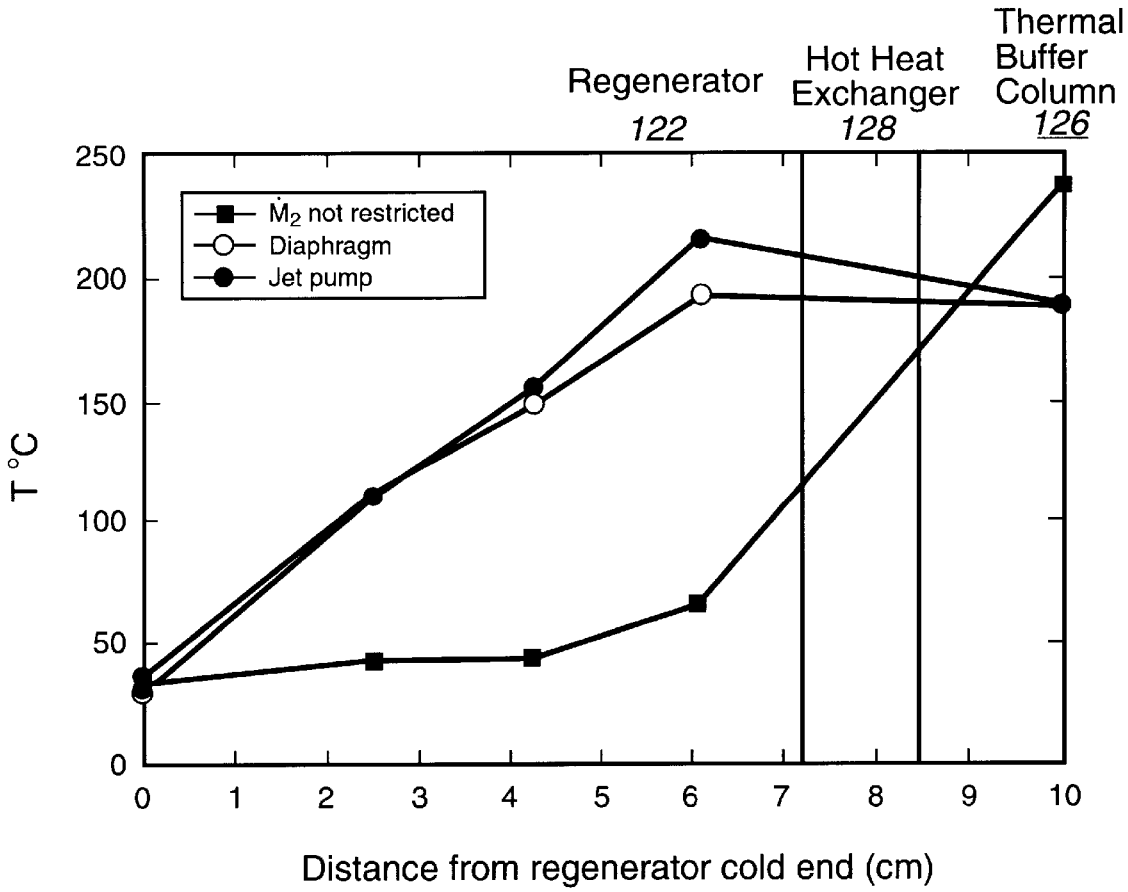
FIG. 9 graphically depicts temperature profiles within the regenerator of the engine shown in FIG. 8.

FIG. 9 shows the temperature distributions in regenerator 122 in these two runs. In both runs, increasing amounts of heat were applied to hot heat exchanger 128 until the pressure amplitude reached $|p_{10}|/p_m\approx0.05$. The only load on the engine was the acoustic resonator itself (not shown). Therefore, $T_H$ should be nearly the same for both cases. With the diaphragm in place, the temperature rises linearly from the ambient end to the hot end. With no $\dot{M}_2$, this linear dependence is expected because the thermal conductivity of helium and stainless steel depend only weakly on temperature.

The temperature distribution with diaphragm 152 removed and $\dot{M}_2$ not restricted is greatly different. Equation 9 and the subsequent discussion show that $\dot{M}_2$ flows in the same direction as the flow of acoustic power. In this case $\dot{M}_2$ enters regenerator 122 from first ambient heat exchanger 132. As seen in FIG. 9, this flux of cold gas reduces the temperature of regenerator 122 for nearly its entire length. The temperature rises quickly near the hot end due to the presence of hot heat exchanger 128. Note that, in FIG. 9, the lines are only guides to the eye, and do not reflect the actual temperatures between the data points. The temperature near 7.2 cm can be assumed to be nearly the same as that at 10 cm. For a rough estimate of $\dot{M}_2$, compare the amounts of heat input, $\dot{Q}_H$, needed to run the engine at this pressure amplitude with and without diaphragm 152. With diaphragm 152 in place, $\dot{Q}_H$=1250 W. Without diaphragm 152, $\dot{Q}_H$=2660 W. This difference in heat input, $\Delta\dot{Q}_H$, should be given by $$\Delta\dot{Q}_H=\dot{M}_2c_p(T_H-T_0) \tag{14}$$

Using Equation (14), $\dot{M}_2\approx1.5\times10^{-3}$ kg/s.

One way to suppress $\dot{M}_2$ is to impose a time averaged pressure drop, $\Delta p_2$ across regenerator 122 that would drive an equal but oppositely directed amount of $\dot{M}_2$ through regenerator 122. The required $\Delta p_2$ can be estimated using the low-Reynolds-number limit of FIG. 7–9 of Kays and London, *Compact Heat Exchangers,* (McGraw-Hill, NY 1964), incorporated herein by reference, $$\frac{dp_2}{dx}\cong\frac{6\dot{M}_2\mu}{\rho_m S r_h^2} \tag{15}$$

for the pressure gradient in a screen bed of cross-sectional area S and hydraulic radius $r_h$, where $\mu$ is the viscosity. The numerical factor depends weakly on the volumetric porosity of the bed. For the data shown in FIG. 9 and the estimate of $\dot{M}_2$, the required pressure drop is 370 Pa.

An alternate way to estimate $\dot{M}_2$ within regenerator 122 is to use Equation (9) and the subsequent discussion, i.e., $\dot{M}_2=\rho_m\dot{W}_2/p_m$. Under the conditions of the experiment, at the ambient end of regenerator 122, $\dot{W}_2$ is calculated to be $\dot{W}_2$=850 W giving $\dot{M}_2=1.3\times10^{-3}$ kg/s. The experimental estimate of $\dot{M}_2$ and the calculation are in rough agreement, suggesting that the estimate of $\Delta p_2$~370 Pa is approximately correct.

In the limit of low viscosity or large tube diameters and in the absence of turbulence, $p_2$ would be described by some acoustic version of the Bernoulli equation. This suggests that an acoustically ideal path connecting the two ends of the regenerator would impose across regenerator 122 a pressure difference of the order of $\Delta[\rho_m u_1\tilde{u}_1]$ where $u_1$ is the complex velocity amplitude. (Such an ideal path might include a thermal buffer column, inertance, and compliance, without heat exchangers or other components having small passages.) This pressure difference is typically much smaller than the $\Delta p_2$ that is required for $\dot{M}_2$=0. Hence, to produce the required $\Delta p_2$ an additional physical effect or structure in the path is needed, relying on turbulence, viscosity, or some other physical phenomenon not included in the Bernoulli equation.

Asymmetry in hydrodynamic end effects can produce this required $\Delta p_2$. In a tapered transition between a small-diameter tube, where $|u_1|$ is large, and a large-diameter tube, where $|u_1|$ is small, turbulence would be avoided and Bernoulli's equation would hold if the taper were sufficiently gentle. At the opposite extreme, for an abrupt transition, a large $|u_1|$ generates significant turbulence, and further the oscillatory pressure drop across an abrupt transition should reflect the phenomena known as "minor losses" in high-Reynolds-number steady flow. If the gas displacement amplitude is much greater than the tube diameter, the flow at any instant of time has little memory of its past history, so that the acoustic behavior can be deduced from careful time integration of the well-known expressions for the steady-flow phenomena.

Figures 10A, 10B:
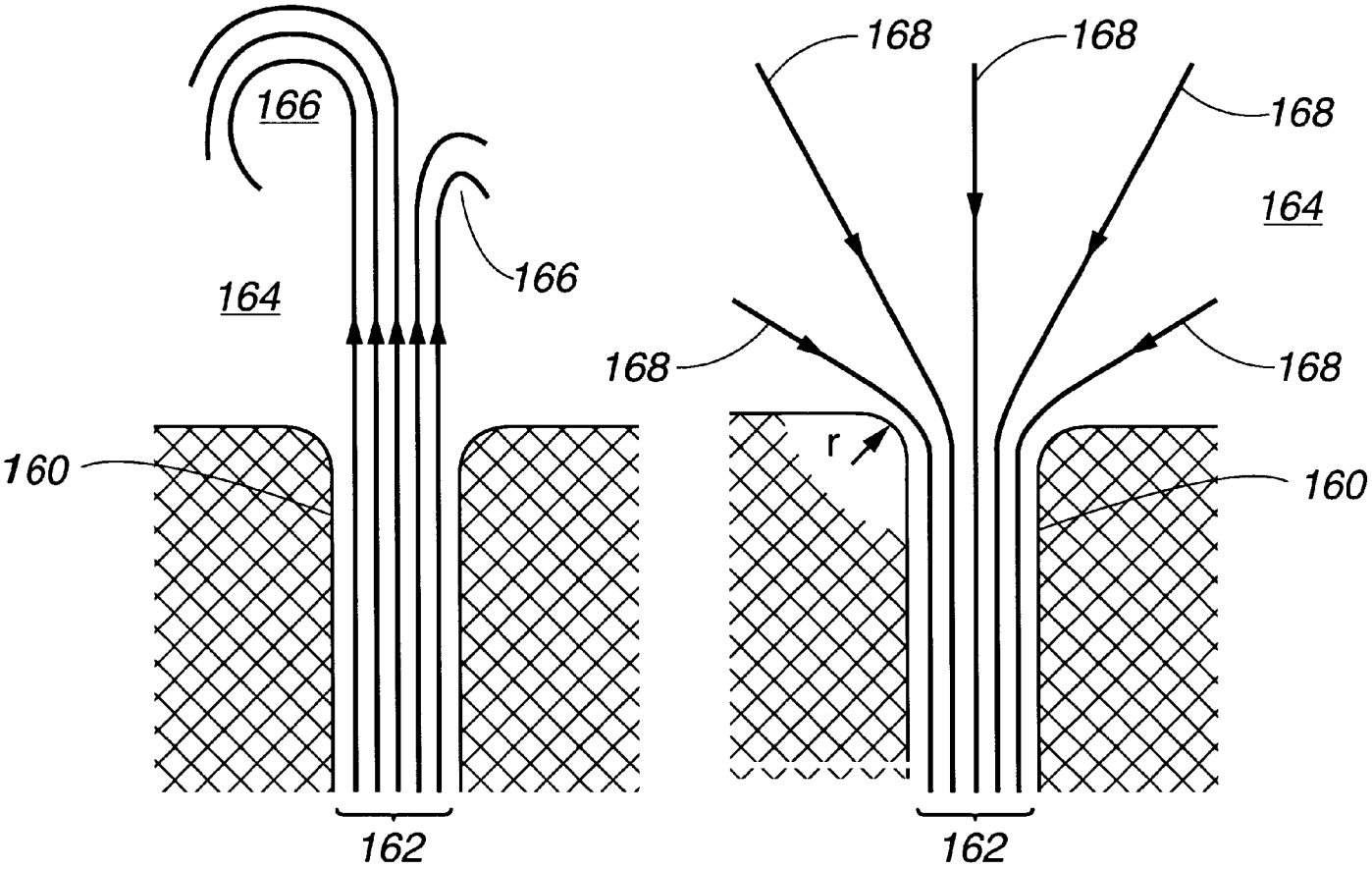
FIGS. 10A and 10B schematically illustrate asymmetric mass flux through a hydrodynamic mass flux suppressor.

In steady flow through an abrupt transition, the minor loss-induced deviation $\Delta p_{ml}$ of the pressure from the Bernoulli equation ideal is given by $$\Delta p_{ml}=K\tfrac{1}{2}\rho u^2 \tag{16}$$

where K is the minor-loss coefficient, which is well known for many transition geometries, and u is the velocity. K depends strongly on the direction of flow through the transition. In the example shown in FIGS. 10A and 10B, a small flanged tube 160 is connected to an essentially infinite open space 164. When a gas 164 (at velocity u inside tube 162) flows out of the tube 162, a jet occurs, and kinetic energy is lost to turbulence 166 downstream of the jet; $K_{out}$=1. In contrast, when gas flows into tube 162, as shown in FIG. 10B, streamlines 168 in open space 164 are widely and smoothly dispersed; K is between 0.5 and 0.04, with smaller values for larger radius r of rounding of the edge of the entrance.

If $u_1=|u_1|\sin\omega t$, the time-averaged pressure drop is obtained by integrating Equation (16) in time:

$$\overline{\Delta p_{ml}}=\frac{\omega}{2\pi}\left(\int_0^{\pi/\omega}K_{out}\frac{1}{2}\rho|u_1|^2\sin^2\omega t\,dt-\int_{\pi/\omega}^{2\pi/\omega}K_{in}\frac{1}{2}\rho|u_1|^2\sin^2\omega t\,dt\right)=\frac{1}{8}\rho|u_1|^2(K_{out}-K_{in}) \tag{17}$$

This hydrodynamic mean pressure difference can be used as the source of $\Delta p_2$ across the regenerator necessary to force $\dot{M}_2$=0. Such simple control of $\dot{M}_2$ is not without penalty, however; acoustic power is dissipated at a rate $$E=S\frac{\omega}{2\pi}\int_0^{2\pi/\omega}\Delta p_{ml}u\,dt=S\frac{\omega}{2\pi}\left(\int_0^{\pi/\omega}K_{out}\frac{1}{2}\rho|u_1|^3\sin\omega t\,dt-\int_{\pi/\omega}^{2\pi/\omega}K_{in}\frac{1}{2}\rho|u_1|^3\sin^3\omega t\,dt\right)=\frac{1}{3\pi}\rho|u_1|^2|U_1|(K_{out}+K_{in}) \tag{18}$$

$$=\frac{8}{3\pi}\overline{\Delta p_{ml}}|U_1|\frac{K_{out}+K_{in}}{K_{out}-K_{in}} \tag{19}$$

where S is the area of the small tube 162. Equation (19) shows that the best way to produce a desired $\overline{\Delta p_{ml}}$ is to insert the hydrodynamic mass-flux suppressor at a location where $|U_1|$ is small, and to shape it so that $K_{out}-K_{in}$ is as large as possible.

In engine 120 (FIG. 8), $|U_1|$ is smallest adjacent to regenerator 122, but that was an inconvenient location for adding an additional component. Second ambient-temperature heat exchanger 134 has only slightly larger $|U_1|$ and already requires some extra dissipation to ensure that $p_{10}$ leads $p_{1H}$ slightly, so the space below second ambient temperature heat exchanger 134 was chosen as the location for experiments on hydrodynamic mass-flux suppression. In this embodiment, hydrodynamic mass-flux suppressor 140 was a "jet pump", formed from a brass block bored through with 25 identical tapered holes, each 1.82 cm long, 8.05 mm diameter at the upper end nearest second ambient temperature heat exchanger 134 and 5.72 mm diameter at the lower end. End effects at the well-rounded small ends of the holes are strongly asymmetric, causing the desired $\overline{\Delta p_{ml}}$, while the velocities at the large ends of the holes are small enough that minor losses are negligible. The tapers joining the ends are gradual enough to prevent minor losses in-between. For the chosen geometry, jet pump 140 was estimated to create a pressure of $\Delta p_2$=930 Pa. However, this estimate is based on a calculation that assumes no interaction between the minor losses at the two ends of jet pump 140. For steady flow, it is known that two minor loss sites located close together result in less $\Delta p_2$ than the sum of the individual $\Delta p_2$'s.

Jet pump 140 was installed and engine 120 was run at the same operating point as the two other sets of data in FIG. 9. The temperature distribution with jet pump 140 was nearly restored to the distribution with rubber diaphragm 152. Also, the amount of heat input needed to reach this operating point with rubber diaphragm 152 was only $Q_H$=1520 W. The additional heat required without the rubber diaphragm 152 was 1400 Watts. The use of jet pump 140 reduced this by 82% to 260 Watts. This clearly demonstrates the effectiveness of jet pump 140.

By using a variable acoustic load (not shown) to increase the acoustic load on the engine, measurements of the temperature distribution were made as a function of $T_H$ at a fixed value of $|p_{10}|/p_m$=0.05. These measurements showed no detectable change in the linearity of the temperature distribution for $200° \leqq T_H \leqq 725°$ C. Therefore, jet pump 140 appeared to be very immune to variations in the load conditions. Finally, by varying $\dot{Q}_H$ at fixed acoustic load, measurements were made of the temperature distribution as function of $p_1$ at fixed $T_H \approx 525°$ C. The temperature distribution did not change in the range $0.03 \leqq |p_{10}|/p_m \leqq 0.05$. At higher pressure amplitudes, the jet pump weakened relative to other sources of $\Delta p_2$. At the highest pressure amplitude achieved, $|p_{10}|/p_m$=0.075, the temperature in the middle of the regenerator dropped from its low amplitude value of 310° C. to 235° C. This amounts to only a 15% change relative to $T_H - T_0 \approx 500°$ C.

Figure 11A:
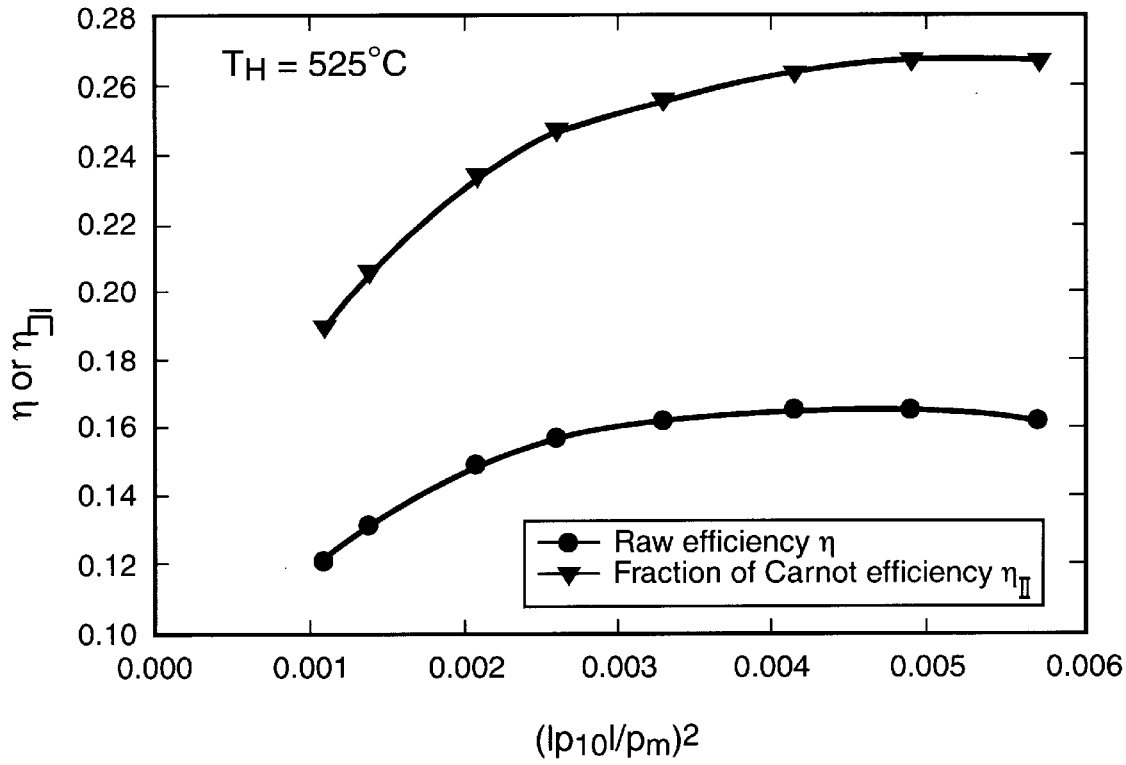
FIG. 11A graphically depicts the efficiencies of the engine shown in FIG. 8 at $T_H$=525° C.
Figure 11B:
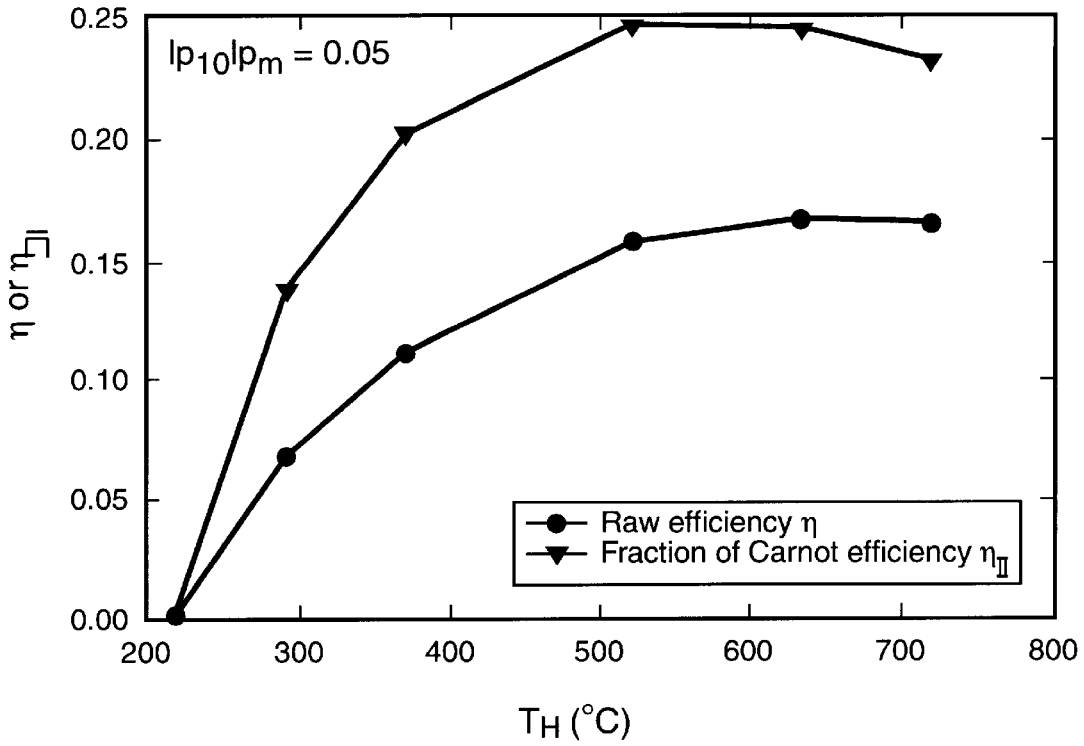
FIG. 11B graphically depicts the efficiencies of the engine shown in FIG. 8 with $|p_1|/p_m$=0.05

The efficiencies obtained during these measurements with jet pump 140 are shown in FIGS. 11A and 11B. During these measurements, the highest efficiency $\eta = \dot{W}/Q_H$=0.17, and the highest fraction of Carnot efficiency, $\eta_H = \eta/\eta_C$=0.27, where the Carnot efficiency is $\eta_C = 1 - T_0/T_H$. With rubber diaphragm 152 in place, the highest observed values were $\eta$=0.21 and $\eta_H$=0.32. In measuring the work output of the engine, $\dot{W}$, only the acoustic power delivered to the variable acoustic load was counted; the resonator dissipation was not included. Hence, these efficiencies represent the engine plus resonator; the efficiencies with which the engine delivered power to the resonator are even higher.

Figure 12A:
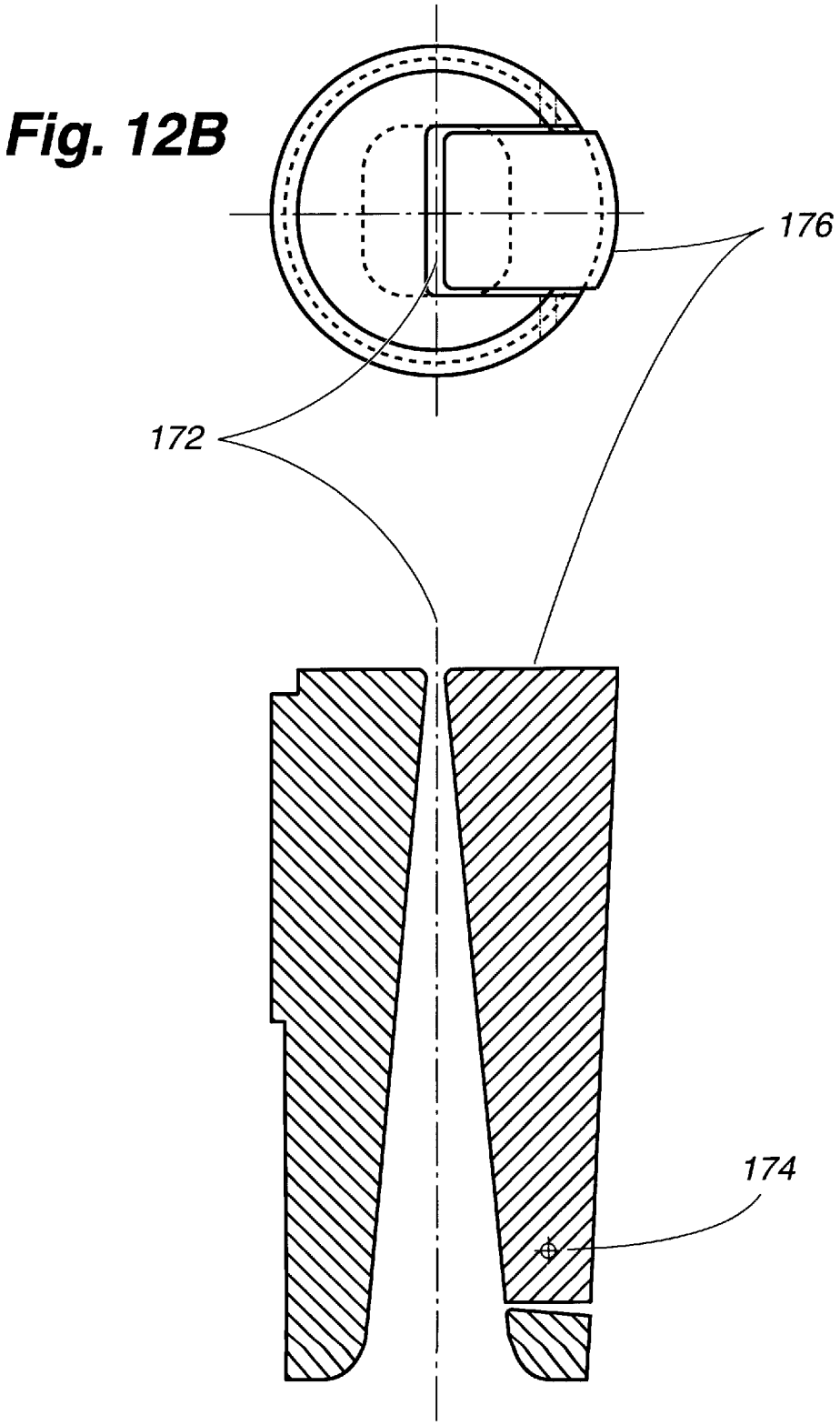

It may sometimes be desirable to adjust the strength of the hydrodynamic method for mass-flux suppression while a traveling-wave device is operating in order to provide whatever $\Delta p_2$ is needed to enforce $\dot{M}_2$=0 over a broad range of operating conditions. To test such a variable hydrodynamic method, the refrigerator apparatus shown in FIG. 6 was modified to include a slit jet pump as shown in FIGS. 12A and 12B in place of flexible diaphragm 108 shown in FIG. 6. Slit 172 provides asymmetric flow as illustrated in FIGS. 10A and 10B, and hence provides $\Delta p_2$ as shown in Equation (17) with $K_{out}$~1 and $K_{in}$~0.1. Pivot point 174 allows right wall 176 of slit 172 to be moved, e.g., by a lever (not shown) connected through a pressure seal to an external knob for manual adjustment or by an automatic controller that is regulated by, e.g., a temperature sensor in the middle of regenerator 98 (FIG. 6). Moving right wall 176 of slit 172 in this way adjusted the area of slit 172, and hence changed $|u_1|$ relative to $|U_1|$ so that $\Delta p_2$ was changed according to Equation (17).

Tests with this setup over a range of $T_C$ (from 0° to −70° C.) and a range of pressure amplitudes $|p_1|/p_m$ (from 0.03 to 0.05) showed that the width of slit 172 could be adjusted to keep the temperature in the middle of regenerator 98 approximately equal to the average of $T_C$ and $T_0$, indicative of $\dot{M}_2$=0. Under these circumstances, the performance of the refrigerator was similar to its performance when flexible diaphragm 108 was used.

The above description of the invention is mostly in terms of a refrigerator with a sub-wavelength torus and with a flexible-barrier method of mass-flux suppression and in terms of an engine with a sub-wavelength torus and with a hydrodynamic method of mass-flux suppression. However, the use of a thermal buffer column and either method of mass-flux suppression is applicable to both engines and refrigerators, whether these engines and refrigerators employ sub-wavelength tori as described herein or more nearly full-wavelength tori as described by Ceperley. It should also be apparent from the description that additional flexible-barrier methods (including bellows) and additional hydrodynamic methods (including the adjustable method discussed above) are also useful. Although mass-flux suppression is described herein as localized, it could be distributed throughout several regions of the apparatus, such as by employing tapered passages in one or more heat exchangers and using asymmetric hydrodynamic effects at the "tee" joining the torus and the side branch (see, e.g., FIG. 8).

It should also be apparent that all aspects of the present invention are as applicable to heat pumps as to refrigerators, that an engine and refrigerator can share the same torus, that multiple devices can share a torus, and that multiple tori can be connected in many ways, such as by sharing a common inertance and a common compliance. In such situations, each torus may require its own mass-flux suppressor, and each heat exchanger at a temperature other than ambient temperature may benefit from an adjacent thermal buffer column.

FIGS. 13A–D illustrate some of these embodiments. In the description of these figures, the terms regenerator, heat exchanger, mass-flux suppressor, thermal buffer, inertance, compliance, and other terms have the same meaning as with the above detailed descriptions and will not be described in detail. It is the arrangement of these components that provides the different embodiments and not the function of the components.

Figure 13A:
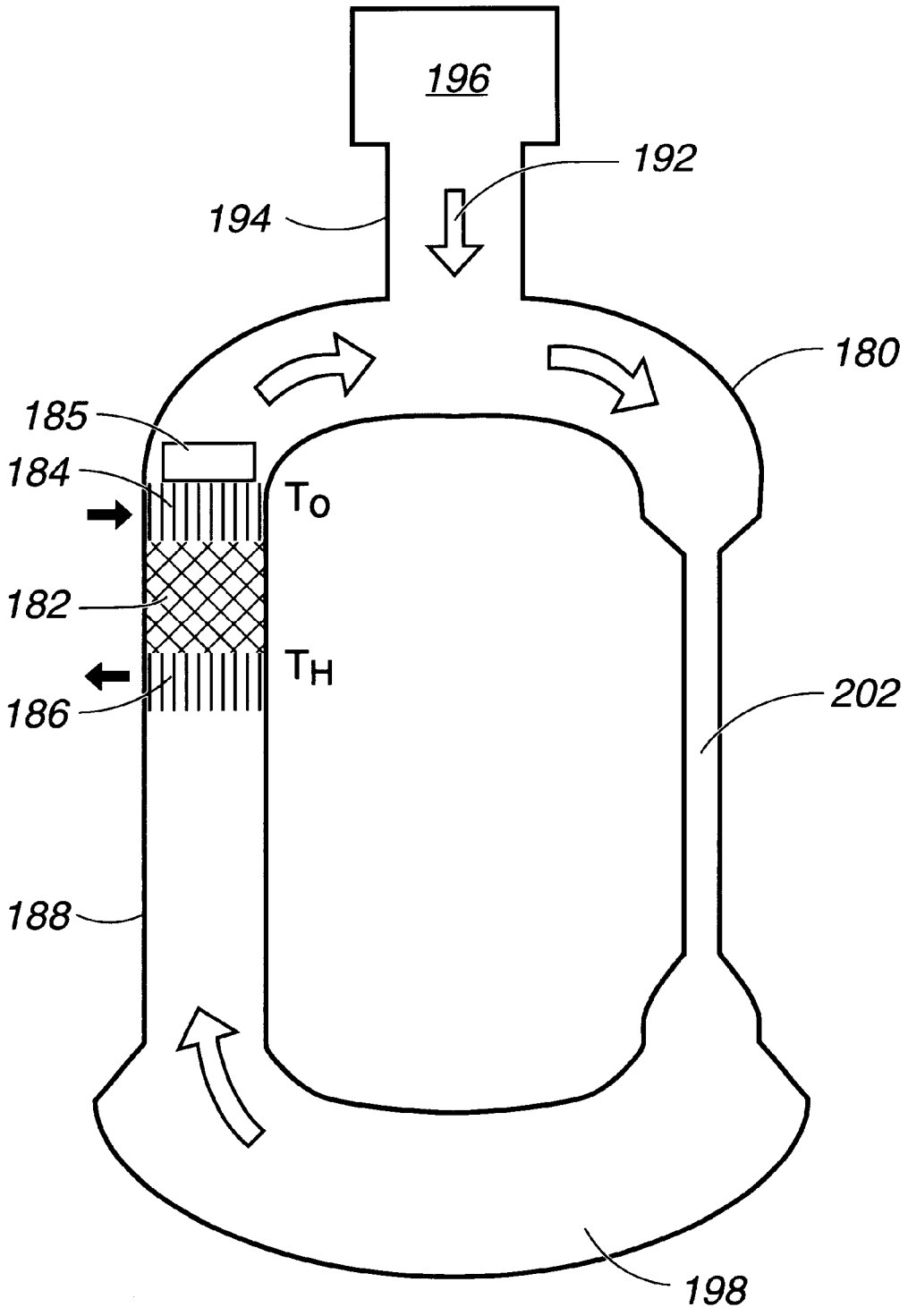
FIG. 13A schematically depicts a heat pump adaptation of the refrigerator shown in FIG. 3.

Referring first to FIG. 13A, there is shown a heat pump configuration of components. Torus 180 defines inertance 202 and compliance 198. Regenerator 182 is located in torus 180 with an ambient heat exchanger 184 downstream from regenerator 182 relative to the circulating acoustic power. Hot heat exchanger 186 is adjacent to and upstream of regenerator 182. Mass flux suppressor 185 is shown downstream from ambient heat exchanger 184 but may be located an any convenient location in torus 180. In this instance, thermal buffer column 188 is located adjacent hot heat exchanger 186, which is the heat exchanger that defines the operating temperature of the device. Acoustic power 192 is generated by acoustic device 196 and input to torus 180 through side branch 194.

Figure 13B:
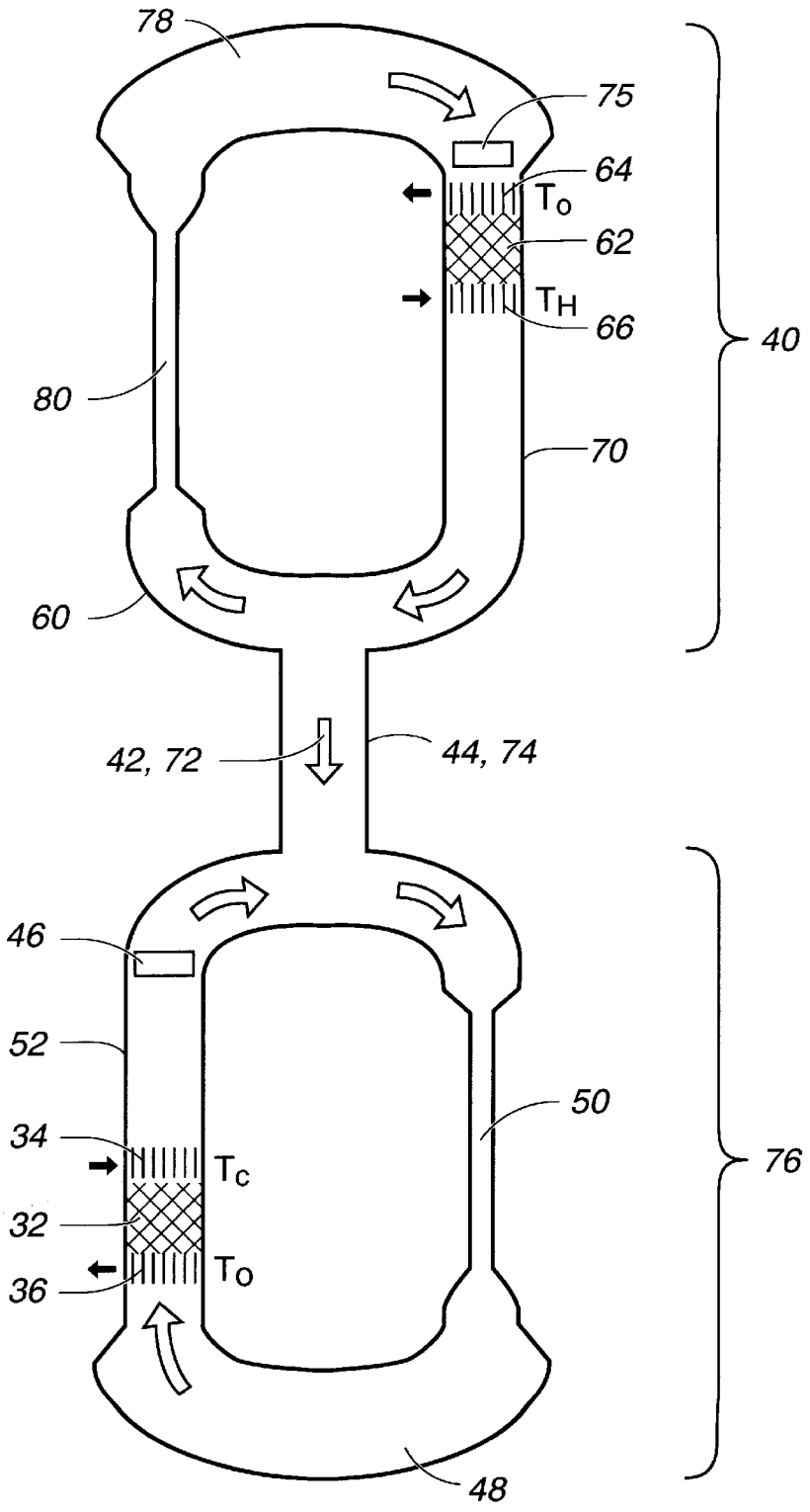
FIG. 13B schematically depicts the refrigerator shown in FIG. 3 driven by the engine shown in FIG. 4.

FIG. 13B depicts a combination of an acoustic source 40 formed by an engine according to the present invention as described in FIG. 4 and an acoustic sink 76 formed by a refrigerator according to the present invention as described in FIG. 3, where like numbers represent like components that can be identified by reference to FIGS. 3 and 4. A common side branch corresponds to side branches 44 and 74 with acoustic power flow 42, 72 as shown in FIGS. 3 and 4.

Figure 13C:
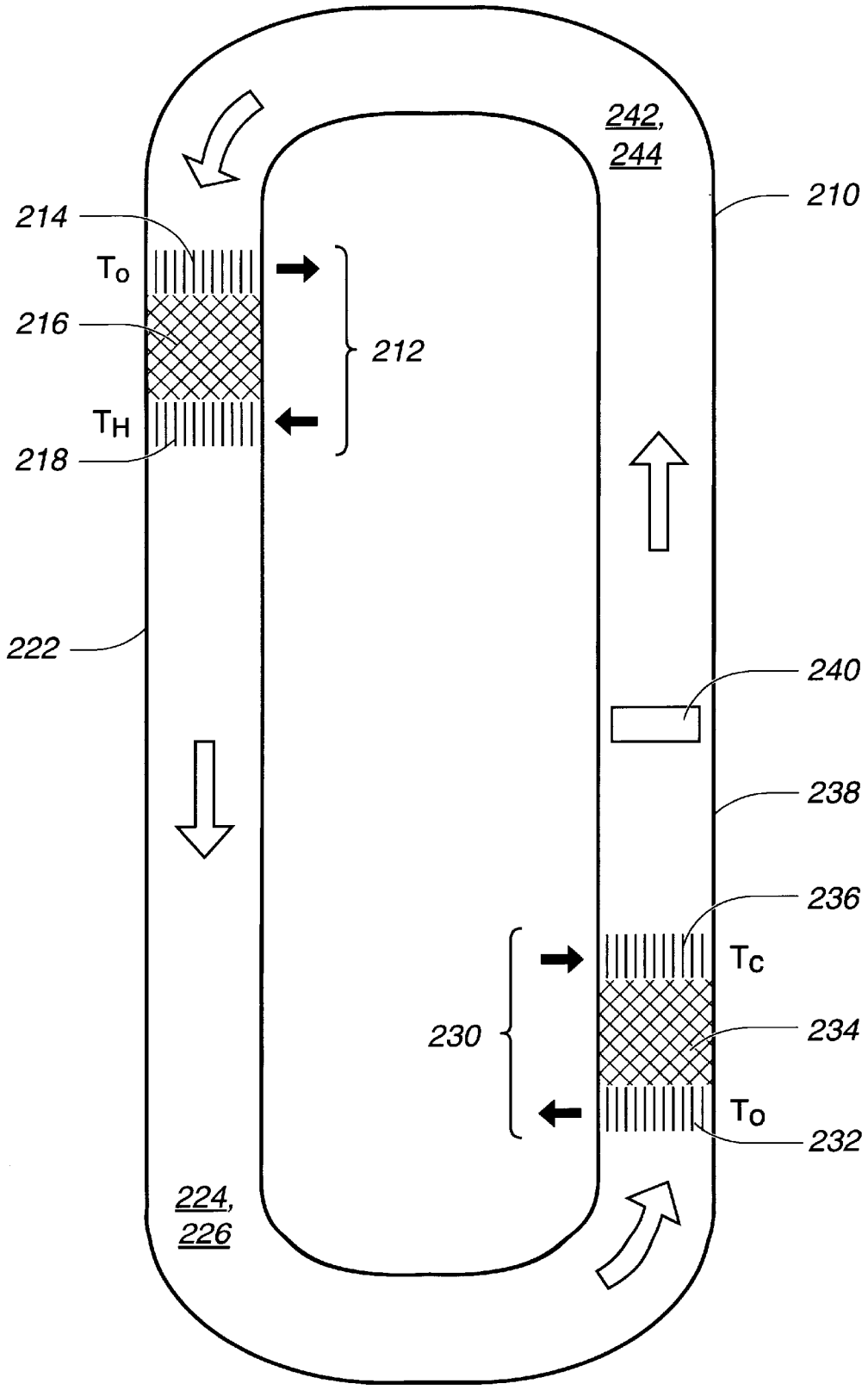
FIG. 13C schematically depicts a heat-driven refrigerator located in a single torus.

FIG. 13C is a further refinement of the embodiment shown in FIG. 13B where engine 212 and refrigerator 230 are incorporated into a single torus 210. Engine 212 includes regenerator 216, with adjacent heat exchangers 214 (ambient temperature) and 218 (operating temperature), with operating temperature heat exchanger 218 downstream from regenerator 216 and adjacent thermal buffer column 222 downstream from operating temperature heat exchanger 218. If needed, engine 212 may have associated inertance 224 and compliance 226 to provide suitable phasing of the output acoustic power.

Refrigerator 230 receives the acoustic power output from engine 212 and includes regenerator 234 with adjacent heat exchangers 232 (ambient temperature) and 236 (operating temperature). Thermal buffer column 238 is downstream from operating temperature heat exchanger 236. If needed, additional inertance 242 and compliance 244 may be defined by torus 210. In accordance with the present invention, mass-flux suppressor 240 is included in torus 210. Suppressor 240 may be generally located anywhere within torus 210 and may be lumped at one location or provided as a distributed suppressor or discrete multiple components within torus 210.

Figure 13D:
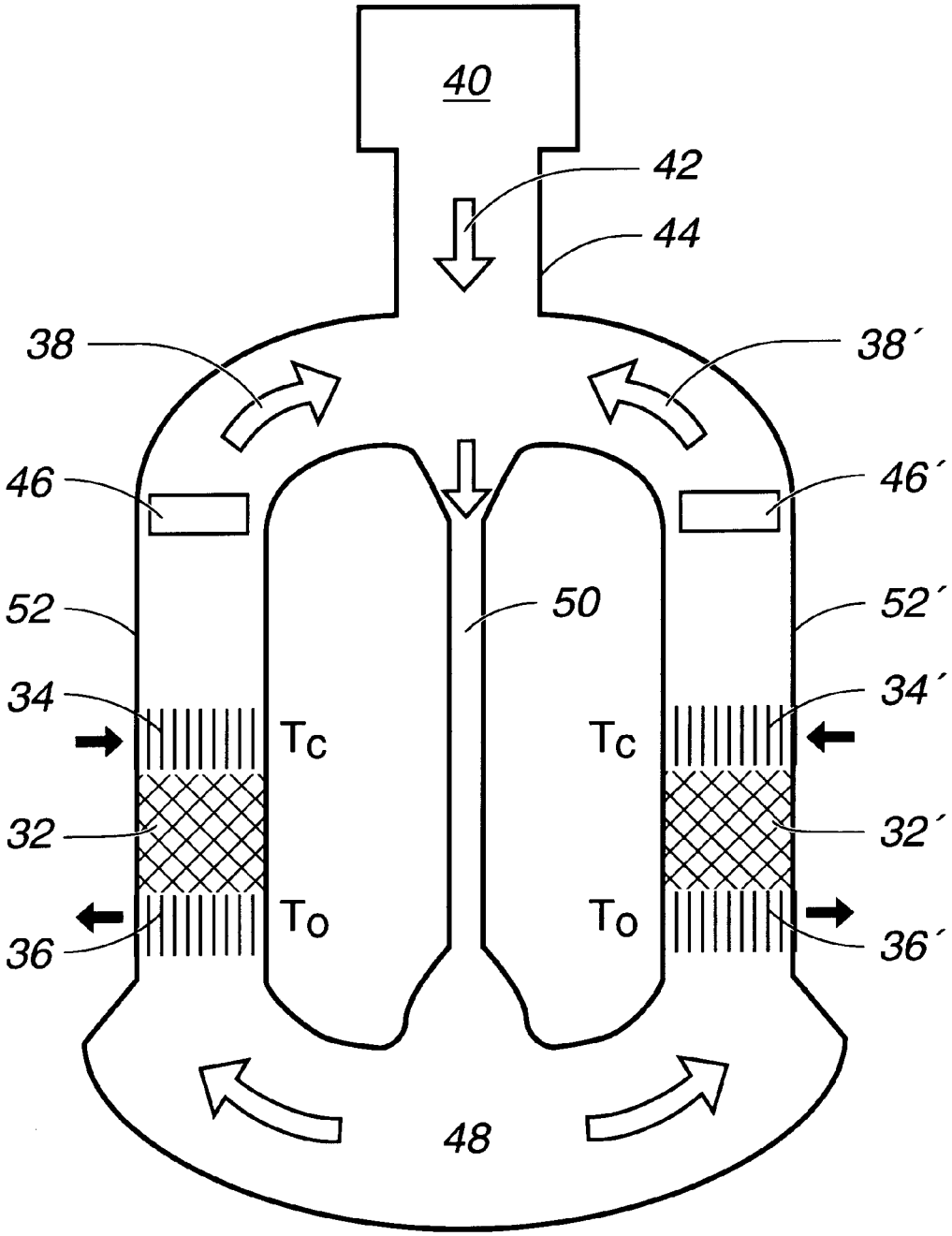
FIG. 13D schematically depicts a plurality of refrigerators shown in FIG. 3 connected in parallel and driven from a single source.

FIG. 13D schematically depicts a parallel configuration of multiples of the refrigerator shown in FIG. 3. Identical components are described with the same reference numbers or primed reference numbers and are individually discussed with reference to FIG. 3. As shown, one or more refrigerator sections may be joined by a common column 50 for the circulating acoustic power 38, 38'. Column 50 may be configured to define a common inertance for the parallel refrigerators. It will be understood that more than two refrigerators may be connected in parallel. Also, while FIG. 13D depicts refrigerators, the same configuration could be used for the engine shown in FIG. 4.

The foregoing description of Stirling cycle traveling-wave refrigerators and engines has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A pistonless traveling-wave device having a. a torus for circulating acoustic energy in a direction through a fluid;

b. a regenerator located in the torus;

c. a first heat exchanger located on a downstream side of the regenerator relative to the direction of the circulating acoustic energy; and d. a second heat exchanger located on an upstream side of the regenerator;

wherein the improvement comprises:

e. a mass-flux suppressor located in the torus to minimize time averaged mass flux of the fluid.

2. A pistonless traveling-wave device according to claim 1, further including:

f. a thermal buffer column located in the torus adjacent the one of the first or second heat exchangers that is at an operating temperature of the traveling-wave device to thermally isolate that heat exchanger.

3. A pistonless traveling-wave device according to either one of claims 1 or 2, wherein the torus is shorter than a wavelength of the circulating acoustic energy.

4. A pistonless traveling-wave device according to claim 3, wherein the torus defines acoustic inertance and acoustic compliance portions.

5. A pistonless traveling-wave device according to claim 2, wherein the thermal buffer column has a diameter much greater than a viscous penetration depth of the fluid.

6. A pistonless traveling-wave device according to claim 2, wherein the thermal buffer column has a length greater than a peak-to-peak fluid displacement amplitude.

7. A pistonless traveling-wave device according to any one of claims 5 or 6, wherein the thermal buffer column is tapered.

8. A pistonless traveling-wave device according to any one of claims 1 or 2, wherein the mass-flux suppressor is a flexible diaphragm.

9. A pistonless traveling-wave device according to any one of claims 1 or 2, wherein the mass-flux suppressor is a hydrodynamic jet pump having a geometry effective to provide asymmetric end effects to generate a pressure drop to oppose mass flux through the jet pump.

10. A pistonless traveling-wave device according to any one of claims 1 or 2, wherein the device is a refrigerator and the downstream heat exchanger is a cold heat exchanger.

11. A pistonless traveling-wave device according to claim 10, wherein the torus is shorter than a wavelength of the circulating acoustic energy.

12. A pistonless traveling-wave device according to claim 11, where the torus defines acoustic inertance and acoustic compliance portions.

13. A pistonless traveling-wave device according to any one of claims 1 or 2, wherein the device is an engine and the downstream heat exchanger is a hot heat exchanger.

14. A pistonless traveling-wave device according to claim 13, wherein the torus is shorter than a wavelength of the circulating acoustic energy.

15. A pistonless traveling-wave device according to claim 14, wherein the torus defines acoustic inertance and acoustic compliance portions.

16. A pistonless traveling-wave device according to any one of claims 1 or 2, wherein the device is a heat pump and the upstream heat exchanger is a hot heat exchanger.

17. A pistonless traveling-wave device according to claim 16, wherein the torus is shorter than a wavelength of the circulating acoustic energy.

18. A pistonless traveling-wave device according to claim 17, wherein the torus defines acoustic inertance and acoustic compliance portions.

19. A pistonless traveling-wave device according to claim 10, further including an engine for generating the acoustic energy having a second regenerator, a hot heat exchanger downstream of the second regenerator relative to a direction for propagating the acoustic energy and an ambient heat exchanger upstream of the second regenerator.

20. A pistonless traveling-wave device according to claim 19, wherein the engine is located in a second torus connected to the torus with the refrigerator and the second torus includes a second mass-flux suppressor.

21. A pistonless traveling-wave device according to claim 19, wherein the engine is located in the torus with the refrigerator.

22. A pistonless traveling-wave device according to claim 10, further including at least a second refrigerator in a second torus, where the second torus has at least a portion of the volume in common with the torus to form a parallel connection of the refrigerator and the second refrigerator.

* * * * *